US011749210B2

(12) United States Patent
Sun et al.

(10) Patent No.: US 11,749,210 B2
(45) Date of Patent: Sep. 5, 2023

(54) SIGNAL CONTROL APPARATUS AND METHOD, DISPLAY CONTROL APPARATUS AND METHOD, AND DISPLAY APPARATUS

(71) Applicants: Chengdu BOE Optoelectronics Technology Co., Ltd., Chengdu (CN); BOE TECHNOLOGY GROUP CO., LTD., Beijing (CN)

(72) Inventors: Kuo Sun, Beijing (CN); Tian Dong, Beijing (CN); Guoqiang Ma, Beijing (CN)

(73) Assignees: Chengdu BOE Optoelectronics Technology Co., Ltd., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/569,015

(22) Filed: Jan. 5, 2022

(65) Prior Publication Data

US 2022/0130338 A1 Apr. 28, 2022

Related U.S. Application Data

(63) Continuation of application No. 16/855,131, filed on Apr. 22, 2020, now Pat. No. 11,250,787, which is a (Continued)

(30) Foreign Application Priority Data

Feb. 2, 2018 (CN) ..... 201810107891.9

(51) Int. Cl.

| | |
|---|---|
| ***G09G 3/3275*** | (2016.01) |
| ***G09G 3/3233*** | (2016.01) |
| ***G09G 3/3266*** | (2016.01) |

(52) U.S. Cl.
CPC ..... *G09G 3/3275* (2013.01); *G09G 3/3233* (2013.01); *G09G 3/3266* (2013.01); (Continued)

(58) Field of Classification Search
None
See application file for complete search history.

(56) References Cited

U.S. PATENT DOCUMENTS

| | | | |
|---|---|---|---|
| 8,730,132 | B2 | 5/2014 | Choi et al. |
| 10,916,184 | B2 | 2/2021 | Xuan et al. |

(Continued)

FOREIGN PATENT DOCUMENTS

| | | | |
|---|---|---|---|
| CN | 1932939 | A | 3/2007 |
| CN | 101826311 | A | 9/2010 |

(Continued)

OTHER PUBLICATIONS

First Office Action, including Search Report, for Chinese Patent Application No. 201810107891.9, dated Jan. 20, 2020, 21 pages.

(Continued)

*Primary Examiner* — Duane N Taylor, Jr.
(74) *Attorney, Agent, or Firm* — Westman, Champlin & Koehler, P.A.

(57) ABSTRACT

A signal control apparatus and method, a display control apparatus and method, and a display apparatus are provided. The display apparatus includes M rows by N columns of pixel driving circuits arranged in an array, the M pixel driving circuits of each column are grouped into at least a first group of pixel driving circuits and a second group of pixel driving circuits, M and N are integer and N is larger than 2. The first group of pixel driving circuits connect to a first data line to receive a data signal, and the second group of pixel driving circuits connect to a second data line to receive a data signal. The signal control apparatus includes (Continued)

a phase shifting circuit which provides a scanning signal to a pixel driving circuit; and a write control circuit which provides a data signal from a data signal terminal to a pixel driving circuit.

18 Claims, 12 Drawing Sheets

Related U.S. Application Data continuation-in-part of application No. 16/123,626, filed on Sep. 6, 2018, now Pat. No. 10,672,343.

(52) U.S. Cl.
CPC ..... *G09G 2310/0248* (2013.01); *G09G 2310/0286* (2013.01)

(56) References Cited

U.S. PATENT DOCUMENTS

| | | | |
|---|---|---|---|
| 2005/0156829 | A1 | 7/2005 | Choi et al. |
| 2005/0264500 | A1 | 12/2005 | Shirasaki et al. |
| 2007/0057877 | A1 | 3/2007 | Choi et al. |
| 2016/0012774 | A1 | 1/2016 | Ohara et al. |
| 2017/0162101 | A1 | 6/2017 | Ohara et al. |
| 2017/0200412 | A1 | 7/2017 | Gu et al. |
| 2018/0059464 | A1 | 3/2018 | Asaumi et al. |
| 2018/0174507 | A1 | 6/2018 | Ohara et al. |
| 2018/0261176 | A1 | 9/2018 | Li |
| 2019/0114954 | A1 | 4/2019 | Xuan et al. |
| 2019/0228713 | A1* | 7/2019 | Tamura ..... G09G 3/3233 |
| 2020/0051491 | A1 | 2/2020 | Xuan et al. |

FOREIGN PATENT DOCUMENTS

| | | | |
|---|---|---|---|
| CN | 105761675 | A | 7/2016 |
| CN | 107564478 | A | 1/2018 |
| CN | 107610640 | A | 1/2018 |

OTHER PUBLICATIONS

USPTO-issued prosecution for U.S. Appl. No. 16/123,626, filed Sep. 6, 2018, including: Non-Corrected Notice of Allowability dated Feb. 27, 2020, 5 pages; Notice of Allowance and Fees Due (PTOL-85) dated Jan. 22, 2020, 8 pages, and Non-Final Rejection dated Oct. 9, 2019, 6 pages; 19 pages total.

USPTO-issued prosecution for U.S. Appl. No. 16/855,131, filed Apr. 22, 2020, including: Notice of Allowance and Fees Due (PTOL-85) dated Oct. 6, 2021, 8 pages; Final Rejection dated Jun. 1, 2021, 8 pages; Non-Final Rejection dated Mar. 10, 2021, 9 pages; 25 pages total.

Second Office Action, including Search Report, for Chinese Patent Application No. 201810107891.9, dated Sep. 30, 2020, 18 pages.

* cited by examiner

SIGNAL CONTROL APPARATUS AND METHOD, DISPLAY CONTROL APPARATUS AND METHOD, AND DISPLAY APPARATUS

CROSS-REFERENCE TO RELATED APPLICATION(S)

This application is a Continuation Application of U.S. application Ser. No. 16/855,131 filed on Apr. 22, 2020, which published as U.S. Publication 2020/0251057, on Aug. 6, 2020, entitled "Control Apparatus And Method, And Display Apparatus", which is a continuation-in-part of U.S. application Ser. No. 16/123,626 filed on Sep. 6, 2018, which issued as U.S. Pat. No. 10,672,343, on Jun. 2, 2020, entitled "Signal Control Apparatus and Method, Display Control Apparatus and Method, Display Apparatus," which in turn claims benefit of Chinese Application No. 201810107891.9, filed with China National Intellectual Property Administration on Feb. 2, 2018, all of which are incorporated herein by reference in their entireties.

TECHNICAL FIELD

The present disclosure relates to the field of display technologies, and in particular, to a signal control apparatus and method, a display control apparatus and method, and a display apparatus.

BACKGROUND

An OLED display apparatus is a display screen made of organic electroluminescent diode, which has good self-luminous performance and display performance, and is considered as an emerging application technology of a next generation of a flat panel display.

The OLED display apparatus mainly comprises a display control circuit and an OLED display substrate. The display control circuit outputs a scanning signal and a data signal which match each other, to drive different pixels in the OLED display substrate by using the scanning signal and the data signal which match each other, thereby realizing screen display of the OLED display apparatus.

SUMMARY

A first aspect of the present disclosure provides a signal control apparatus for a display apparatus, the display apparatus comprising M rows by N columns of pixel driving circuits arranged in an array, wherein the M pixel driving circuits of each column of pixel driving circuits are grouped into at least a first group and a second group, M and N each being an integer and N being larger than 2, and the first group of pixel driving circuits are connected to a first data line to receive a data signal, and the second group of pixel driving circuits are connected to a second data line to receive a data signal, the signal control apparatus including:

a phase shifting circuit configured to provide a scanning signal to a pixel driving circuit; and a write control circuit connected to N data signal terminals, and configured to provide a data signal from the N data signal terminal to the pixel driving circuits, the N data signal terminals corresponding to the N columns of pixel driving circuits one by one, wherein the write control circuit includes N switching units, the N switching units corresponding to the N data signal terminals and the N columns of pixel driving circuits one by one, and wherein each of the N switching units includes a first switching device and a second switching device, and wherein the first switching device has an input terminal connected to the corresponding data signal terminal, an output terminal connected to the first data line, and a control terminal connected to a first control signal terminal, and wherein the second switching device has an input terminal connected to the corresponding data signal terminal, an output terminal connected to the second data line, and a control terminal connected to a second control signal terminal, and wherein the first and second switching devices of each switching units are controlled to be sequentially turned on so as to provide the data signal from the corresponding data signal terminal to the first and second group of pixel driving circuits respectively.

According to an embodiment of the present disclosure, the phase shift circuit is controlled so that it provides a scanning signal to a pixel driving circuit for a period longer than a period for which the write control circuit provides the data signal from the corresponding data signal terminal to the pixel driving circuit.

According to an embodiment of the present disclosure, a frequency of the data signal provided from the data signal terminal is 90 Hz.

According to an embodiment of the present disclosure, the M pixel driving circuits of each column of pixel driving circuits are assigned to the first and second groups sequentially.

According to an embodiment of the present disclosure, the phase shifting circuit is configured to provide a scanning signal to a row of pixel driving circuits from both sides of the row of pixel driving circuits.

According to an embodiment of the present disclosure, the phase shifting circuit includes a phase shifter and a first register, the phase shifter is connected to an input terminal of the first register, an output terminal of the first register is connected to M scanning signal terminal, and the M scanning signal terminals correspond to M pixel driving circuits in the same column of pixel driving circuits one by one.

According to an embodiment of the present disclosure, the signal control apparatus further includes a light emitting signal modulation circuit, and the light emitting signal modulation circuit is controlled to generate a light emitting signal and provide it to a pixel driving circuit, to cause the pixel driving circuit that receives the light emitting signal to drive a light emitting device to emit light.

A second aspect of the present disclosure further provides a signal control method applied to the signal control apparatus as described above, including:

providing a scanning signal to a pixel driving circuit; and providing a data signal to a pixel driving circuit via the corresponding data signal terminal, wherein the scanning signal is provided to a pixel driving circuit for a period longer than a period for which the pixel driving circuit is provided with the data signal via the corresponding data signal terminal.

According to an embodiment of the present disclosure, before providing the scanning signal to the pixel driving circuit, the signal control method further includes providing a reset signal to the pixel driving circuit to cause the pixel driving circuit to enter a reset phase.

According to an embodiment of the present disclosure, the signal control method further includes controlling the pixel driving circuit to drive a light emitting device to emit light.

A third aspect of the present disclosure further provides a display control apparatus comprising the signal control apparatus as described above.

The present disclosure further provides a signal control method applied to the signal control apparatus as described above, including:

a data writing step of providing a scanning signal to a current row of pixel driving circuits, and at the same time, providing a data signal from a data signal terminal to the current row of pixel driving circuit, such that the current row of pixel driving circuits writes the data signal for a data writing period;

stopping providing the data signal to the current row of pixel driving circuits via the data signal terminal after the data writing period lapses, and proceeding to a mutual capacitance charging step;

the mutual capacitance charging step of utilizing a mutual capacitance of a data line corresponding to each pixel driving circuit in the current row of pixel driving circuits while continuing providing the scanning signal to the current row of pixel driving circuits, so that the data line corresponding to each pixel driving circuit in the current row of pixel driving circuits charges the corresponding pixel driving circuit until no scanning signal is provided to the current row of pixel driving circuits.

According to an embodiment of the present disclosure, the signal control method further includes performing the data writing step and the mutual capacitance charging step for a next row of pixel driving circuits.

According to an embodiment of the present disclosure, after the mutual capacitance charging step, the signal control method further includes:

a driving step of controlling the current row of pixel driving circuits to drive a light emitting device to emit light.

According to an embodiment of the present disclosure, before the data writing step, the signal control method further includes:

a resetting step of providing a reset signal to the current row of pixel driving circuits to cause the current row of pixel driving circuits to enter a reset phase.

A fourth aspect of the present disclosure further provides a display apparatus comprising the display control apparatus as described above.

BRIEF DESCRIPTION OF THE DRAWINGS

The drawings described herein are intended to provide a further understanding of the present disclosure, and are intended to be a part of the present disclosure. The illustrative embodiments of the present disclosure and the description thereof are for explaining the present disclosure and do not constitute an undue limitation of the present disclosure. In the drawings:

FIG. 4-1 is a wiring diagram of 3 columns by 4 rows of pixel driving circuits according to another embodiment of the present disclosure;

FIG. 6-1 is a wiring diagram of 3 columns by 4 rows of pixel driving circuits according to another embodiment of the present disclosure;

DETAILED DESCRIPTION

Figure 1:
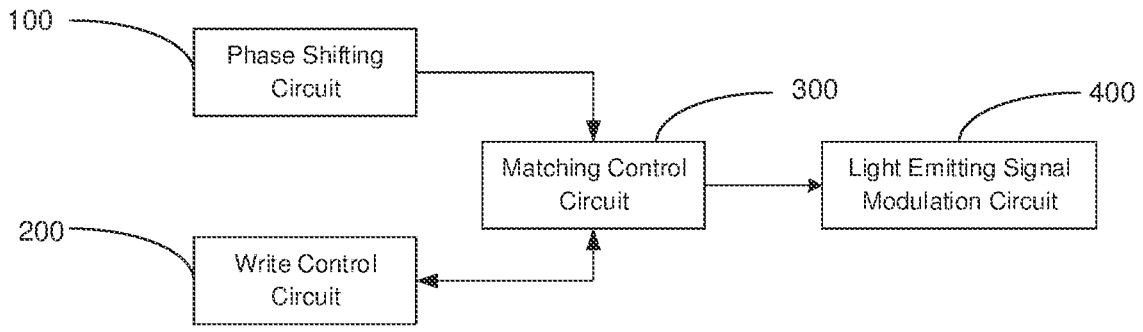
FIG. 1 is a structure block diagram of a signal control apparatus according to an embodiment of the present disclosure.

The technical solutions in the embodiments of the present disclosure are clearly and completely described in the following with reference to the accompanying drawings in the embodiments of the present disclosure. It is obvious that the described embodiments are only a part of the embodiments of the present disclosure, and not all of the embodiments. All other embodiments obtained by those of ordinary skill in the art based on the embodiments of the present disclosure without creative efforts are within the scope of the present disclosure.

When an OLED display apparatus performs screen display, the frequency of the data signal used is relatively small (60 Hz), and the time taken for the OLED display apparatus to display one frame of screen is long, resulting in poor fluency of the screen displayed by the OLED display apparatus. When the frequency of the data signal used is relatively high (e.g., 90 Hz or 120 Hz), the time period taken for the OLED display apparatus to display one frame of screen is relatively short, and fluency of the screen displayed by the OLED display apparatus is good.

However, when the frequency of the data signal used is higher, the time period for writing the data signal to a corresponding pixel is shorter, which causes the pixel to emit light with insufficient data signal written, and easily causes a problem of insufficient light emitting brightness, thereby affecting display effect of the OLED display apparatus.

According to the technical solution of the present disclosure, a high frequency data signal may be used to drive the display apparatus to display, thereby improving display effect of the display apparatus.

Referring to FIG. 1 to FIG. 6, a signal control apparatus for a display apparatus according to an embodiment of the present disclosure includes: a phase shifting circuit 100, a write control circuit 200, and a matching control circuit 300. The display apparatus comprises an array of M rows by N columns of pixel driving circuits, wherein the M pixel driving circuits of each column of pixel driving circuits are divided into k groups, wherein k is greater than or equal to 2 and less than N, and the ith pixel driving circuit of each column of pixel driving circuits is assigned to the [i Mod k]th group, and a same group of pixel driving circuits are connected to a same data line to receive a data signal, and the data lines connected to different groups of pixel driving circuits are different. That is, for each column of pixel driving circuits, there are k data lines. The number of pixel driving circuits included in each group of pixel driving circuits is at least 1. Assuming that each group of pixel driving circuits includes a number r of pixel driving circuits, the number r of pixel driving circuits are arranged in a corresponding group according to the number of the row at which they are located. "Mod" is a remainder operator. For sake of brief, if the remainder is 0, the corresponding group is recorded as the kth group. For example, if k=2 and M=6, the first row of pixel driving circuits is assigned to [1 mod 2]=1, the first group, the second row of pixel driving circuits is assigned to [2 mod 2]=0, the second group, the third row of pixel driving circuits is assigned to [3 mod 2]=1, the first group, the fourth row of pixel driving circuits is assigned to [4 mod 2]=0, the second group, the fifth row of pixel driving circuits is assigned to [5 mod 2]=1, the first group, and the sixth row of pixel driving circuits is assigned to [6 mod 2]=0, the second group. As another example, if k=3 and M=6, the first row of pixel driving circuits is assigned to [1 mod 3]=1, the first group, the second row of pixel driving circuits is assigned to [2 mod 3]=2, the second group, the third row of pixel driving circuits is assigned to [3 mod 3]=0, the third group, the fourth row of pixel driving circuits is assigned to [4 mod 3]=1, the first group, the fifth row of pixel driving circuits is assigned to [5 mod 3]=2, the second group, and the sixth row of pixel driving circuits is assigned to [6 mod 3]=0, the third group.

The phase shifting circuit 100 is configured to provide a scanning signal to the pixel driving circuit to cause the pixel driving circuit to enter a data signal writing phase, wherein a phase difference between the scanning signals of adjacent two pixel driving circuits in the same group of pixel driving circuits in the same column of pixel driving circuits is equal to T, and a phase difference between the scanning signals of adjacent two pixel driving circuits in the same column of pixel driving circuits is equal to T/k, and T is a duration of the data signal writing phase of each pixel driving circuit.

The write control circuit 200 is connected to a data signal terminal Vdata, and configured to provide a data signal from the data signal terminal to the pixel driving circuit for a data writing period of $T_i$=T/k.

The matching control circuit 300 is connected to the phase shifting circuit 100 and to the write control circuit 200, and configured to control the write control circuit 200 to provide a data signal to a pixel driving circuit that receives a scanning signal, when the phase shifting circuit 100 provides the scanning signal to the pixel driving circuit.

Since the phase difference between the scanning signals of adjacent two pixel driving circuits in the same column of pixel driving circuits is equal to T/k, the data writing start times of adjacent two pixel driving circuits in the same column of pixel driving circuit are different by T/k.

Figure 2:
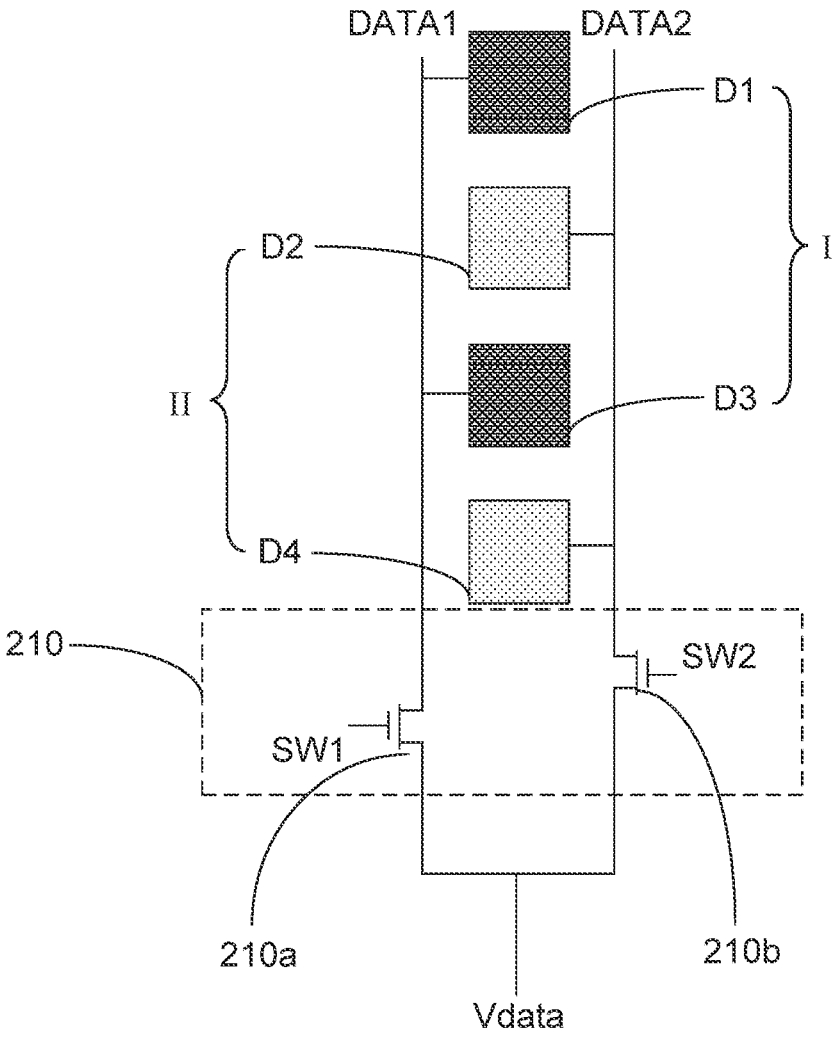
FIG. 2 is a wiring diagram of 1 column by 4 rows of pixel driving circuits according to an embodiment of the present disclosure.
Figure 3:
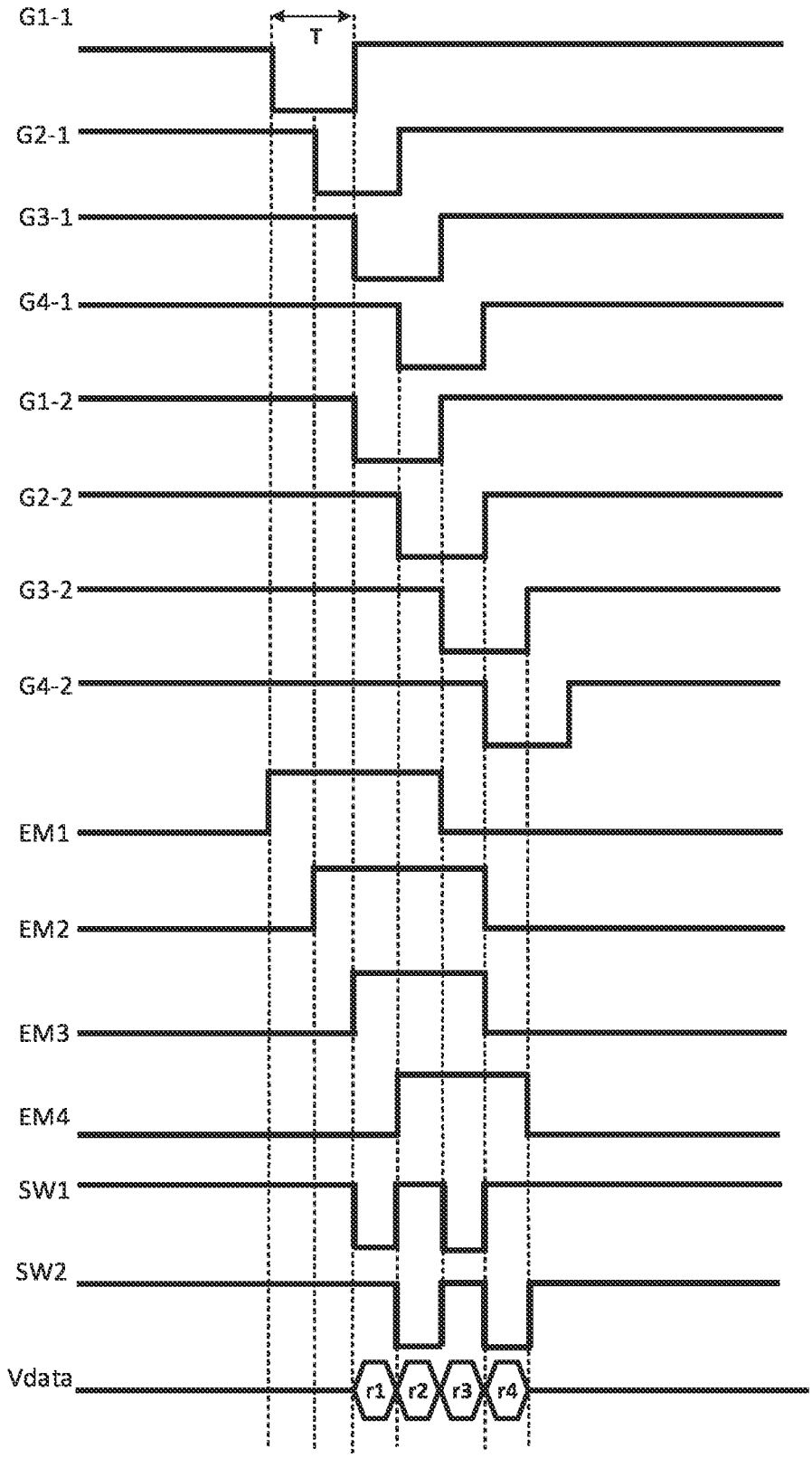
FIG. 3 is a signal control timing diagram according to an embodiment of the present disclosure.
Figure 4:
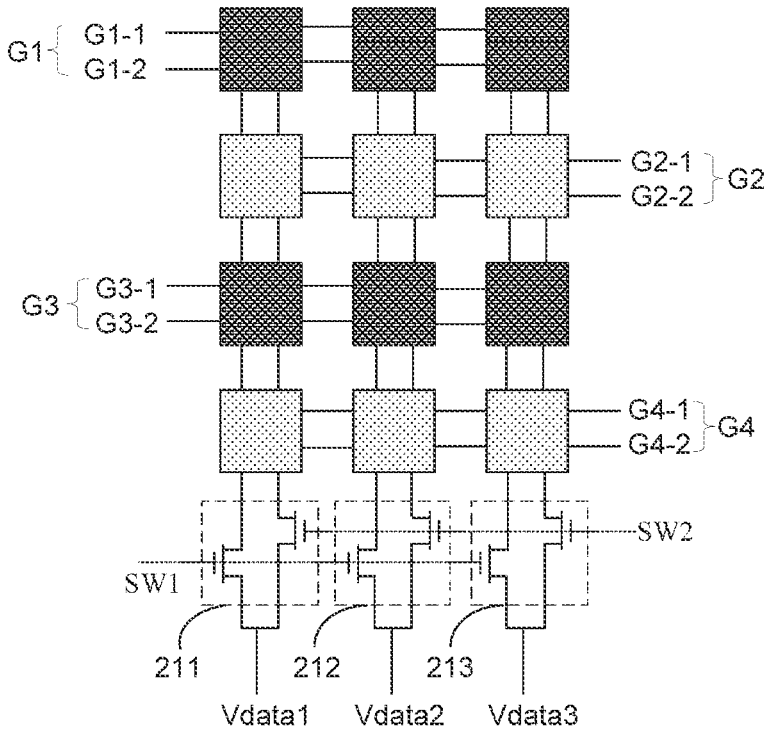
FIG. 4 is a wiring diagram of 3 columns by 4 rows of pixel driving circuits according to an embodiment of the present disclosure.
Figures 1, 4:
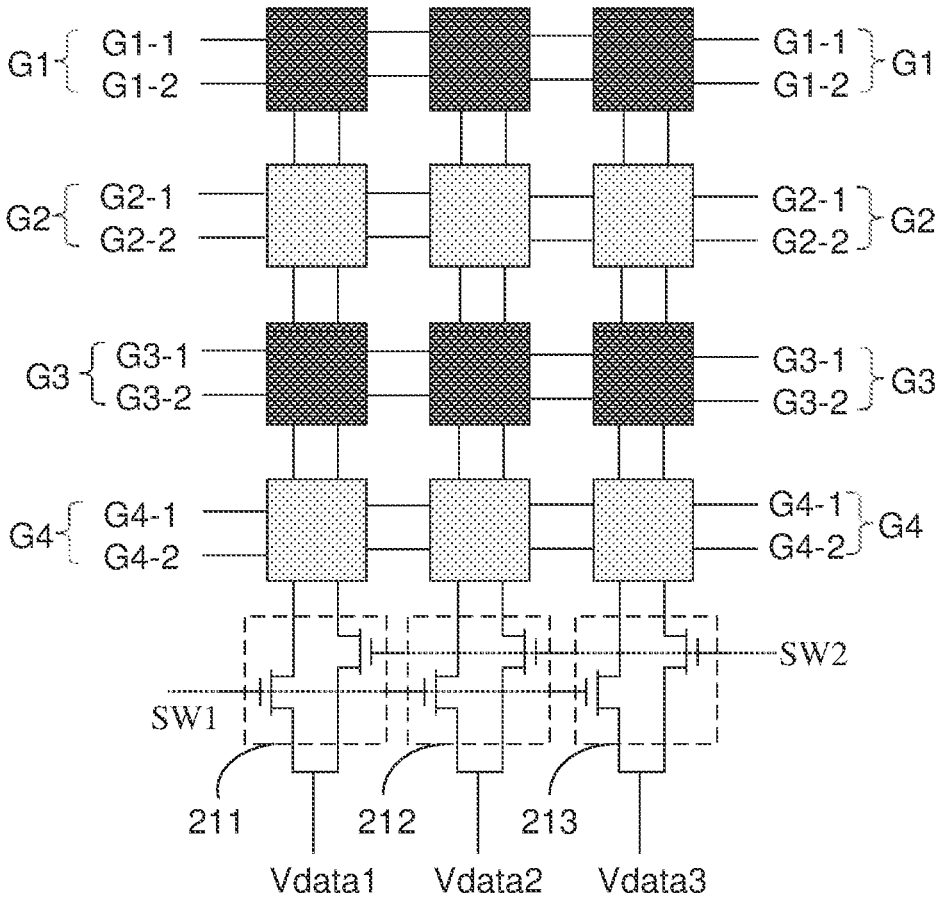

In order to more clearly illustrate the signal control device according to the embodiment of the present disclosure, applying the signal control apparatus to 1 column by 4 rows of pixel driving circuits shown in FIG. 2 and 3 columns by 4 rows of pixel driving circuits shown in FIG. 4 is described in detail.

In FIG. 2 and FIG. 4, M=4 and k=2. The pixel driving circuits filled with the same shading belong to the same group of pixel driving circuits. For FIG. 2 and FIG. 4, one column of pixel driving circuits is divided into two groups, each group of pixel driving circuits includes two pixel driving circuits; for one column of pixel driving circuits, the first group I of pixel driving circuits includes a first pixel driving circuit D1 and a third pixel driving circuit D3, and the second group II of pixel driving circuits includes a second row D2 of pixel driving circuits and a fourth row D4 of pixel driving circuits. A column of pixel driving circuits includes a first data line DATA1 and a second data line DATA2, which correspond to the first group I of pixel driving circuits and the second group II of pixel driving circuits, respectively. The first data line DATA1 is respectively connected to the first pixel driving circuit D1 and the third pixel driving circuit D3 included in the first group I of pixel driving circuits. The second data line DATA2 is connected to the second pixel driving circuit D2 and the fourth pixel driving circuit D4 included in the second group II of pixel driving circuits.

Exemplarily, the phase shifting circuit 100 phase shifts the scanning signals of the first group I of pixel driving circuits and the second group II of pixel driving circuits in the same column of pixel driving circuits, so that the phase difference between the scanning signal of the pixel driving circuit D1 and the scanning signal of the third pixel driving circuit D3 included in the first group I of pixel driving circuits is equal to T, and the phase difference between the scanning signal of the second pixel driving circuit D2 and the fourth pixel driving circuit D4 included in the second group II of pixel driving circuits is equal to T. Meanwhile, the phase difference between scanning signals of adjacent two pixel driving circuits in the same column is equal to T/2. Taking FIG. 2 as an example, the first pixel driving circuit D1 is adjacent to the second pixel driving circuit D2, the second pixel driving circuit D2 is adjacent to the third pixel driving circuit D3, and the third pixel driving circuit D3 is adjacent to the fourth pixel driving circuit D4. It can be seen from FIG. 3 that the scanning signal of the first pixel driving circuit D1 and the scanning signal of the second pixel driving circuit D2 have a phase difference of T/2, the scanning signal of the second pixel driving circuit D2 and the scanning signal of the third pixel driving circuit D3 have a phase difference of T/2, the scanning signal of the third pixel driving circuit D3 and the scanning signal of the fourth pixel driving circuit D4 have a phase difference of T/2, and T is a duration of the data signal writing phase of each pixel driving circuit.

The write control circuit 200 provides a data signal to the pixel driving circuit for a data writing period of Ti=T/2.

In the above case, for the same column of pixel driving circuits, the phase shifting circuit 100 transmits the scanning signal to the first row of pixel driving circuits for a period. When the period reaches T/2, the phase shifting circuit 100 transmits the scanning signal to the second row of pixel driving circuits. When the period reaches T, the phase shifting circuit 100 transmits the scanning signal to the third row of pixel driving circuits, and when the period reaches 3T/2, the phase shifting circuit 100 transmits the scanning signal to the fourth row of pixel driving circuits. It can be seen that, for one column by four rows of pixel driving circuits, the signal control apparatus according to the embodiment of the present disclosure sequentially starts to output the scanning signal to four rows of pixel driving circuits within a time period of 2T, which is reduced by half compared with the conventional time period of 4T.

As shown in FIG. 3, the matching control circuit 300 controls the write control circuit 200 to provide the data signal to a pixel driving circuit that receives a scanning signal when the phase shift circuit 100 provides the scanning signal to the pixel driving circuit. The duration of the data signal writing phase of each pixel driving circuit is equal to T. The write control circuit 200 provides the data signal to the first row of pixel driving circuits when the first row of pixel driving circuits receive the scanning signal to enter the data signal writing phase. When the period after the first row of pixel driving circuit enters the data signal writing phase reaches T/2 (i.e., the data writing period), the write control circuit 200 stops providing the data signal to the first row of pixel driving circuits, and starts to provide the data signal to the second row of pixel driving circuits. A mutual capacitance occurs between the first data line DATA1 and other wires when transmitting the data signal to the first row of pixel driving circuits. Therefore, although the write control circuit 200 stops providing the data signal to the first row of pixel driving circuits, the mutual capacitance of the first data line DATA1 (a capacitance of about 20 pF) causes the first data line DATA1 to continue charging the first row of pixel driving circuits until the period after the first row of pixel driving circuits enters the data signal writing phase reaches T. That is, the first row of pixel driving circuits ends the data signal writing phase, and the first data line DATA1 stops charging the first row of pixel driving circuits. At this time, the period after the second row of pixel driving circuits enters the data signal writing phase reaches T/2, the write control circuit 200 stops providing the data signal to the second row of pixel driving circuits, and starts to provide the data signal to the third row of pixel driving circuits. Similarly, after the write control circuit 200 stops providing the data signal to the second row of pixel driving circuits, the mutual capacitance between the second data line DATA2 and the other wires occurring when transmitting the data signal to the second row of pixel driving circuits causes the second data line DATA2 to continue charging the second row of pixel driving circuits until the period after the second row of pixel driving circuits enters the data signal writing phase reaches T. That is, the second row of pixel driving circuits ends the data signal writing phase, and the second data line DATA2 stops charging the second row of pixel driving circuits. At this time, the period after the third row of pixel driving circuits enters the data signal writing phase reaches T/2, the write control circuit 200 stops providing the data signal to the third row of pixel driving circuits, and starts to provide the data signal to the fourth row of pixel driving circuits. Similarly, after the write control circuit 200 stops providing the data signal to the third row of pixel driving circuits, the mutual capacitance between the first data line DATA1 and the other wires occurring when transmitting the data signal to the third row pixel driving circuits causes the first data line DATA1 to continue charging the third row of pixel driving circuits until the period after the third row of pixel driving circuits enters the data signal writing phase reaches T. That is, the third row of pixel driving circuits ends the data signal writing phase. At this time, the period after the fourth row of pixel driving circuits enters the data signal writing phase reaches T/2, and the write control circuit 200 stops providing the data signal to the fourth row of pixel driving circuits. Similarly, after the write control circuit 200 stops providing the data signal to the fourth row of pixel driving circuits, the mutual capacitance between the second data line DATA2 and the other wires occurring when transmitting the data signal to the fourth row of pixel driving circuits causes the second data line DATA2 to continue charging the fourth row of pixel driving circuits until the period after the fourth row of pixel driving circuits enters the data signal writing phase reaches T. That is, the fourth row of pixel driving circuits ends the data signal writing phase.

It can be seen from the specific implementation of the signal control apparatus according to the embodiments of the present disclosure that the write control circuit 200 controls the data writing period of each pixel driving circuit in a column of pixel driving circuits corresponding to a data signal terminal Vdata to be $T_i$=T/k (k is larger than or equal to 2) such that the data writing starting times of adjacent two pixel driving circuits in a column of pixel driving circuit corresponding to the data signal terminal Vdata have a time difference of T/k; that is, for a column of pixel driving circuits, in one data signal writing phase of a pixel driving circuit, the write control circuit 200 can output a data signal to k different pixel driving circuits. The phase shifting circuit 100 causes the scanning signals outputted to adjacent two pixel driving circuits in the same group of pixel driving circuits of the same column of pixel driving circuits to have a phase difference of T, and causes the scanning signals outputted to two adjacent pixel driving circuits in the same column of pixel driving circuits to have a phase difference of T/k. That is, for the same column of pixel driving circuits, the phase shifting circuit 100 can start to output scanning signals to k different pixel driving circuits in one scanning signal output phase T.

It can be seen that, for a column of pixel driving circuits, in the duration of one data signal writing phase, the write control circuit 200 can complete the data signal output of k different pixel driving circuits, and the phase shifting circuit 100 outputs the scanning signals to k different pixel driving circuits in the duration of one scanning signal output phase. Since the matching control circuit 300 controls the write control circuit 200 to provide the data signal to a pixel driving circuit that receives a scanning signal when the phase shifting circuit 100 provides the scanning signal to the pixel driving circuit, so that in the duration of one data signal writing phase, the phase shifting circuit 100 can sequentially provide the scanning signal to k different pixel driving circuits to ensure k different pixel driving circuits that receive the scanning signal to complete data signal writing. Therefore, in the signal control apparatus according to the embodiment of the present disclosure, when a column of pixel driving circuits has M (at least 2) pixel driving circuits, the time period required for completing data signal writing of the column of pixel driving circuits is equal to T*M/k, while in the related art, the time period is T*M. That is to say, it is possible for the signal control apparatus according to the present disclosure of the embodiment to drive a display screen with a high-frequency data so that the refresh rate of display screen increase, thereby improving the fluidity of the display screen.

Exemplarily, as shown in FIG. 2, when the frequency of the data signal provided from the data signal terminal Vdata is λ0, the time period required for data signal writing of one frame screen is 1/λ0, and T=k/(λ0×M), wherein M is the number of pixel driving circuits in a column of pixel driving circuits, and M is an integer greater than or equal to 2.

For example, in the related art, if λ0=60 Hz and M=1920, the duration of the data signal writing phase of one pixel driving circuit is 1/(λ0×M)=1/(60×1920)=8.6 μs, if λ0=120 Hz and M=1920, the duration of the data signal writing phase of one pixel driving circuit is 1/(λ0×M)=1/(120×

1920)=4.3 μs, and if λ0=90 Hz and M=1920, the duration of the data signal writing phase of one pixel driving circuit is 1/(λ0×M)=1/(90×1920)=5.78 μs. However, in the signal control apparatus according to the embodiment of the present disclosure, if k=2, the duration of the data signal writing phase of one pixel driving circuit is 2/(λ0×M)=2/(120×1920)=8.6 μs.

For example, in the related art, if λ0=60 Hz and M=2560, the duration of the data signal writing phase of one pixel driving circuit is 1/(λ0×M)=1/(60×2560)=6.5 μs, and if λ0=120 Hz and M=1920, the duration of the data signal phase of one pixel driving circuit is 1/(λ0×M)=1/(120×2560)=3.25 μs. However, in the signal control apparatus according to the embodiment of the present disclosure, if k=2, the duration of the data signal writing phase of one pixel driving circuit is 2/(λ0×M)=2/(120×2560)=6.5 μs.

For example, in the related art, if λ0=45 Hz and M=1920, the duration of the data signal writing phase of one pixel driving circuit is 1/(λ0×M)=1/(45×1920)=11.57 μs, and if λ0=90 Hz and M=1920, the duration of the data signal writing phase of one pixel driving circuit is 1/(λ0×M)=1/(90×1920)=5.78 μs. However, in the signal control apparatus according to the embodiment of the present disclosure, if λ0=90 Hz, M=1920, and k=2, the duration of the data signal writing phase of one pixel driving circuit is 2/(λ0×M)=2/(90×1920)=11.57 μs.

For example, in the related art, if λ0=45 Hz and M=2560, the duration of the data signal writing phase of one pixel driving circuit is 1/(λ0×M)=1/(45×2560)=8.68 μs, and if λ0=90 Hz and M=2560, the duration of the data signal phase of one pixel driving circuit is 1/(λ0×M)=1/(90×2560)=4.3 μs. However, in the signal control apparatus according to the embodiment of the present disclosure, if λ0=90 Hz, M=2560, and k=2, the duration of the data signal writing phase of one pixel driving circuit is 2/(λ0×M)=2/(90×2560)=4.3 μs.

For example, in the related art, if λ0=45 Hz and M=3120, the duration of the data signal writing phase of one pixel driving circuit is 1/(λ0×M)=1/(45×3120)=7.12 μs, and if λ0=90 Hz and M=3120, the duration of the data signal writing phase of one pixel driving circuit is 1/(λ0×M)=1/(90×3120)=3.56 μs. However, in the signal control apparatus according to the embodiment of the present disclosure, if λ0=90 Hz, M=3120, and k=2, the duration of the data signal writing phase of one pixel driving circuit is 2/(λ0×M)=2/(90×3120)=7.12 μs.

For example, in the signal control apparatus according to the embodiment of the present disclosure, if λ0=90 Hz and M=3120, k=2, and the blank of a frame period is 10T, the duration of the data signal writing phase of one pixel driving circuit is 1/(λ0×M)=1/(90×(3120+blank))=3.538 μs.

It can be seen that the signal control apparatus according to the embodiment of the present disclosure can control the phase of the scanning signal received by the pixel driving circuit and the data writing period, so that when the data signal terminal Vdata outputs a high frequency (for example, 90 Hz) data signal, the display time period of one frame image is reduced, but it can achieve the same light emitting brightness effect as that with a low frequency data signal.

In addition, in the signal control apparatus according to the embodiment of the present disclosure, although the data writing period of each pixel driving circuit is $T_i$=T/k, the period (T) of the scanning signal provided from the phase shifting circuit 100 does not change. When the matching control circuit 300 controls the write control circuit 200 to stop providing the data signal to the pixel driving circuit that receives the scanning signal, the phase shifting circuit 100 still provides the scanning signal to the pixel driving circuit. The data line corresponding to the pixel driving circuit that receives the scanning signal has a mutual capacitance with the other wires when transmitting the data signal, so that after the write control circuit 200 provides the data signal to the pixel driving circuit that receives the scanning signal (i.e., the data writing period of $T_i$=T/k), the data line corresponding to the pixel driving circuit that receives the scanning signal can charge the pixel driving circuit that still receives the scanning signal to compensate for insufficient data signal writing due to the time period required for the write control circuit 200 to provide the data signal to the pixel driving circuit that receives the scanning signal being too short, thereby ensuring the data signal writing requirement of the pixel driving circuit, so that the brightness of the screen displayed by the display apparatus is uniform.

Figure 5:
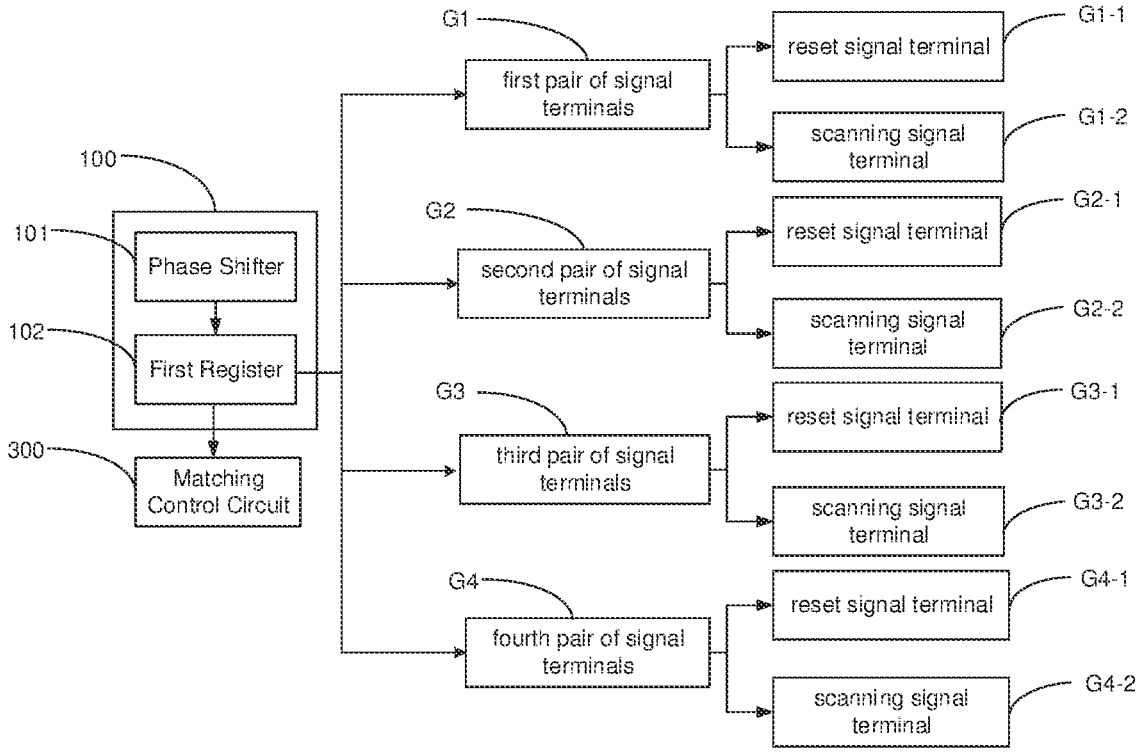
FIG. 5 is a specific block diagram of a phase shifting circuit according to an embodiment of the present disclosure.

Specifically, as shown in FIG. 4 and FIG. 5, the phase shifting circuit 100 of the embodiment of the present disclosure includes a phase shifter 101 and a first register 102. The phase shifter 101 is connected to an input of the first register 102, an output of the first register 102 is connected to M pairs of signal terminals, and the M pairs of signal terminal correspond to the M pixel driving circuits in the same column pixel driving circuit one by one.

The phrase that first items correspond to second items "one by one" used herein means that the first items has a one-to-one correspondence with the second items. For example, a first one of the first items corresponds to a first one of the second items, a second one of the first items corresponds to a second one of the second items, a third one of the first items corresponds to a third one of the second items, and so on.

Each pair of scanning lines includes a reset signal terminal and a scanning signal terminal. A reset signal provided from the reset signal terminal is used to control a duration of a reset phase of a corresponding pixel driving circuit, and the scanning signal provided from the scanning signal terminal is used for controlling the duration of the data signal writing phase of the corresponding pixel driving circuit.

The phase shifter 101 is configured to modulate a trigger signal such that the phase difference between the reset signal and the scanning signal provided from the first register 102 according to the trigger signal is equal to T. A phase difference between the scanning signals of adjacent two pixel driving circuits in the same group of pixel driving circuits in the same column of pixel driving circuits is equal to T and a phase difference between the scanning signals of adjacent two pixel driving circuits in the same column of pixel driving circuits is equal to T/k under the control of the phase shifting circuit 100. Therefore, the phase difference between the reset signals of adjacent two pixel driving circuits in the same group of pixel driving circuits in the same column of pixel driving circuits is also T, and the phase difference between the reset signals of adjacent two pixel driving circuits in the same column of pixel driving circuits is equal to T/k.

The matching control circuit 300 is connected to the first register 102. The matching control circuit 300 is configured to control the write control circuit 200 to provide the data signal to a pixel driving circuit that receives a scanning signal when the first register 102 provides the scanning signal to the pixel driving circuit, so as to ensure cooperative matching of scanning signals and data signals provided to the same pixel driving circuit.

Exemplarily, as shown in FIG. 2, FIG. 4 and FIG. 5, for 1 column by 4 rows or 3 columns by 4 rows of pixel driving circuits, a column of pixel driving circuits has 4 rows of pixel driving circuits. Therefore, an output of the first register 102 is connected to four pairs of signal terminals, and the four pairs of signal terminals are a first pair of signal terminals G1, a second pair of signal terminals G2, a third pair of signal terminals G3, and a fourth pair of signal terminals G4. The first pair of signal terminals G1 includes a reset signal terminal G1-1 and a scanning signal terminal G1-2, the second pair of signal terminals G2 includes a reset signal terminal G2-1 and a scanning signal terminal G2-2, a third pair of signal terminal G3 includes a reset signal terminal G3-1 and a scanning signal terminal G3-2, and the fourth pair of signal terminals G4 includes a reset signal terminal G4-1 and a scanning signal terminal G4-2.

Figure 6:
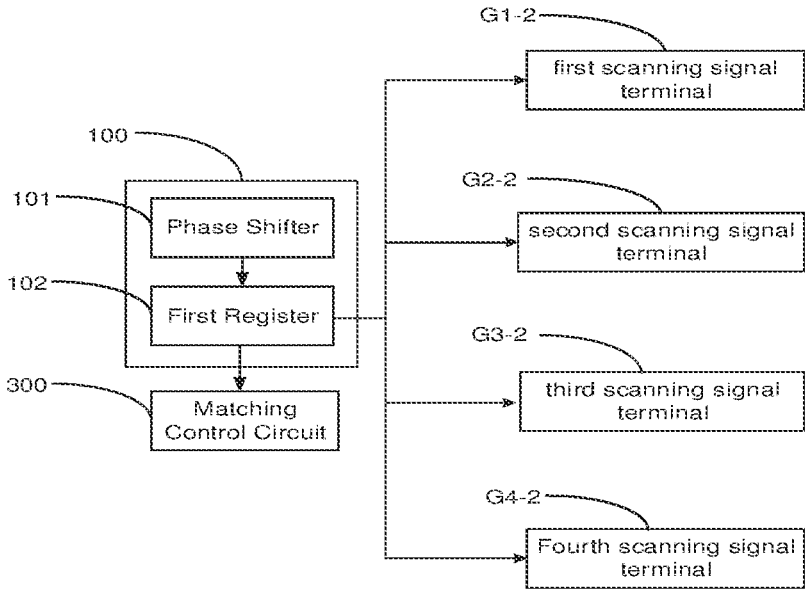
FIG. 6 is a specific block diagram of a phase shifting circuit according to another embodiment of the present disclosure.
Figures 1, 6:
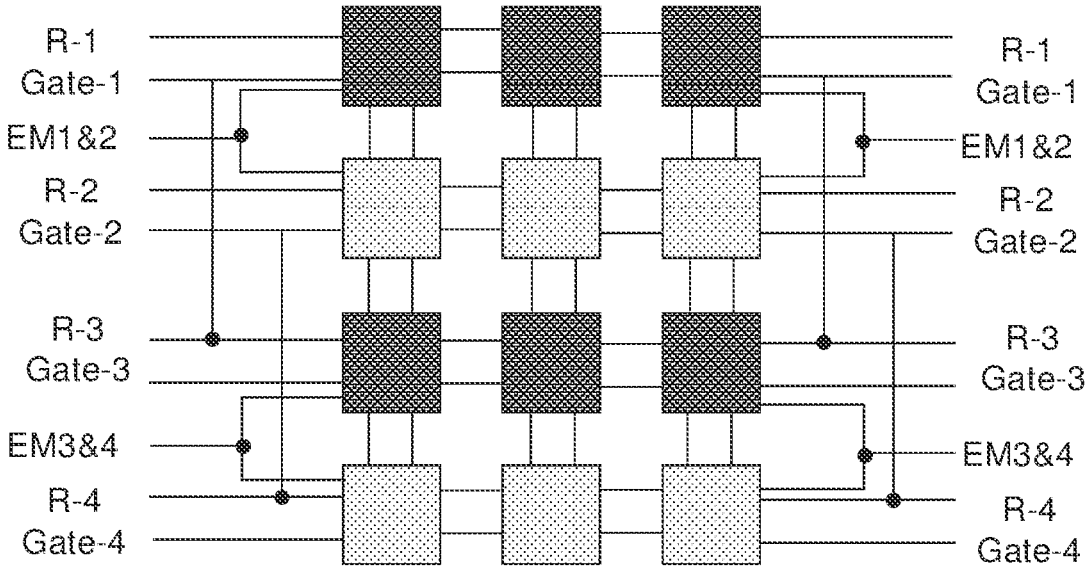

As another embodiment, as shown in FIG. 6, the output of the first register 102 is connected to M scanning signal terminals, and the M scanning signal terminal correspond to the M pixel driving circuits in the same column pixel driving circuit one by one.

Exemplarily, as shown in FIG. 2, FIG. 4 and FIG. 6, for 1 column by 4 rows or 3 columns by 4 rows of pixel driving circuits, a column of pixel driving circuits has 4 rows of pixel driving circuits. Therefore, an output of the first register 102 is connected to four scanning signal terminal, and the four scanning signal terminals are a first scanning signal terminal G1-2, a second scanning signal terminal G2-2, a third scanning signal terminal G3-2, and a fourth scanning signal terminals G4-2.

The reset signal terminal of an nth row of pixel driving circuit thus can be connected to the scanning signal terminal of an (n−2)th row of pixel driving circuit.

For example, the reset signal terminal G3-1 is connected to the scanning signal terminal G1-2, the reset signal terminal G4-1 is connected to the scanning signal terminal G2-2.

FIG. 6-1 illustrates another example of a wiring diagram of 3 columns by 4 rows of pixel driving circuits according to an embodiment of the present disclosure. As shown in FIG. 6, the scanning signal terminal of the first row of pixel driving circuits is connected to the reset signal terminal R-3 of the third row of pixel driving circuits, and the scanning signal terminal of the second row of pixel driving circuits is connected to the reset signal terminal R-4 of the third row of pixel driving circuits. The reset signal terminals of the first and second row of pixel driving circuits may be connected to the phase shifting circuit to receive the respective reset signals.

FIG. 6-1 also shows a case where the light emitting signals for two rows of pixel driving circuits are provided from a light emitting signal driving circuit. It is merely an example. In another example, the light emitting signal driving circuit may be configured to provide a light emitting signal for each row of pixel driving circuits, or provide light emitting signals for three rows of pixel driving circuits. The present disclosure is not limited thereto.

As shown in FIG. 2 to FIG. 4, for a column of pixel driving circuits, the phase difference between the reset signal and the scanning signal of the pixel driving circuit is equal to T. For example, a phase difference between a reset signal and a scanning signal of a first pixel driving circuit D1 is equal to T, a phase difference between a reset signal and a scanning signal of a second pixel driving circuit D2 is equal to T, and a phase difference between a reset signal and a scanning signal of a third pixel driving circuit D3 is equal to T. A phase difference between reset signals of adjacent two pixel driving circuits in the same group of pixel driving circuits in the same column pixel driving circuit is equal to T. For example, in a column of pixel driving circuits, a phase difference between a reset signal of the first pixel driving circuit D1 and a reset signal of the third pixel driving circuit D3 included in the first group I of pixel driving circuits is equal to T, and a phase difference between a reset signal of the second pixel driving circuit D2 and a reset signal of a fourth pixel driving circuit D4 included in the second group II of pixel driving circuits is equal to T.

The phase difference of the reset signals of adjacent two pixel driving circuits in the same column of pixel driving circuit is equal to T/2. For example, in one column of pixel driving circuits, the phase difference between the reset signal of the first pixel driving circuit D1 and the reset signal of the second pixel driving circuit D2 is equal to T/2; the phase difference between the reset signal of the second pixel driving circuit D2 and the reset signal of the third pixel driving circuit D3 is equal to T/2; and the phase difference between the reset signal of the third pixel driving circuit D3 and the reset signal of the fourth pixel driving circuit D4 is equal to T/2.

Since the phase difference between the reset signal and the scanning signal of one pixel driving circuit is equal to T, the phase difference between the scanning signal of the first pixel driving circuit D1 and the scanning signal of the second pixel driving circuit D2 is equal to T/2. The phase difference between the scanning signal of the second pixel driving circuit D2 and the scanning signal of the third pixel driving circuit D3 is equal to T/2. The phase difference between the scanning signal of the third pixel driving circuit D3 and the scanning signal of the fourth pixel driving circuit D4 is equal to T/2.

As can be seen from FIG. 3, the matching control circuit 300 is configured to control the write control circuit 200 to provide the data signal to a pixel driving circuit that receives a scanning signal when the first register 102 provides the scanning signal to the pixel driving circuit. That is, when the pixel driving circuit starts to receive the scanning signal, the write control circuit 200 provides the data signal to the pixel driving circuit. Since the write control circuit 200 controls the data writing period of each pixel driving circuit in a column of pixel driving circuits corresponding to the data signal terminal Vdata to be $T_i$=T/2, when the write control circuit 200 stops providing the data signal to the pixel driving circuit, the pixel driving circuit is still in the data signal writing phase, and the data signal writing phase will last for a time period of T/2. During the remaining T/2 time period, the stored charge due to the mutual capacitance (about 20 pF) of the data line connected to the pixel driving circuit occurring when transmitting the data signal is used to continue charging the pixel driving circuit.

In the embodiment, by grouping the pixel driving circuits in at least two groups, and providing at least two data lines corresponding to the at least two groups respectively, a pixel driving circuit may be charged for a period longer than a period for which the pixel driving circuit is provided with the data signal. For example, as shown in FIG. 3, each row of pixel driving circuits are provided with the data signal for a period of T/2 while each row of pixel driving circuits are provided with the scanning signal for a period of T, i.e., they are charged for a period of T. The row of pixel driving circuits is firstly charged with the data signal provided from the data signal terminal, and then charged with the mutual capacitance of the data line the row of pixel driving circuits is connected to.

Figure 7:
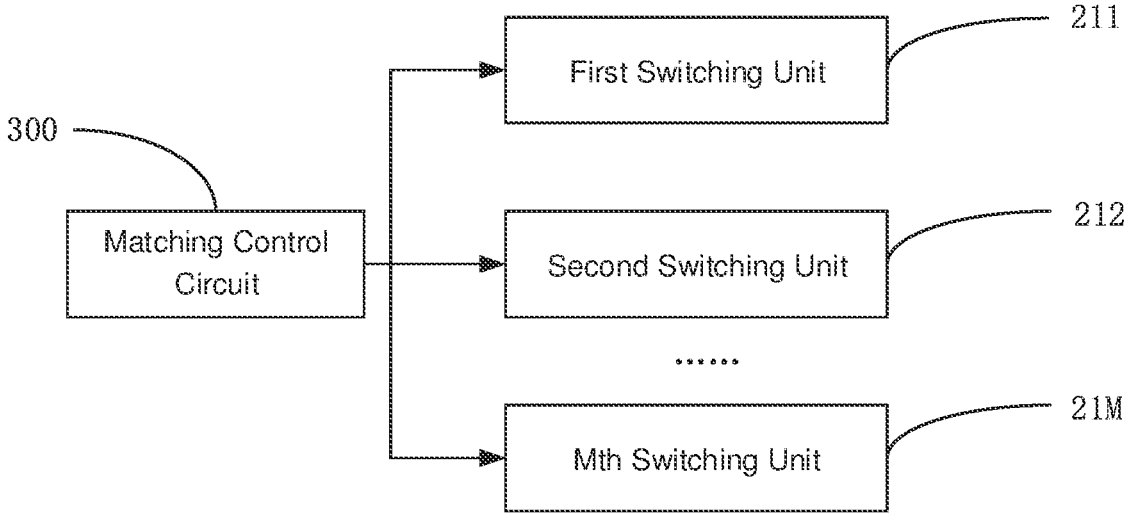
FIG. 7 is a structure block diagram of a write control circuit according to an embodiment of the present disclosure.
Figure 8:
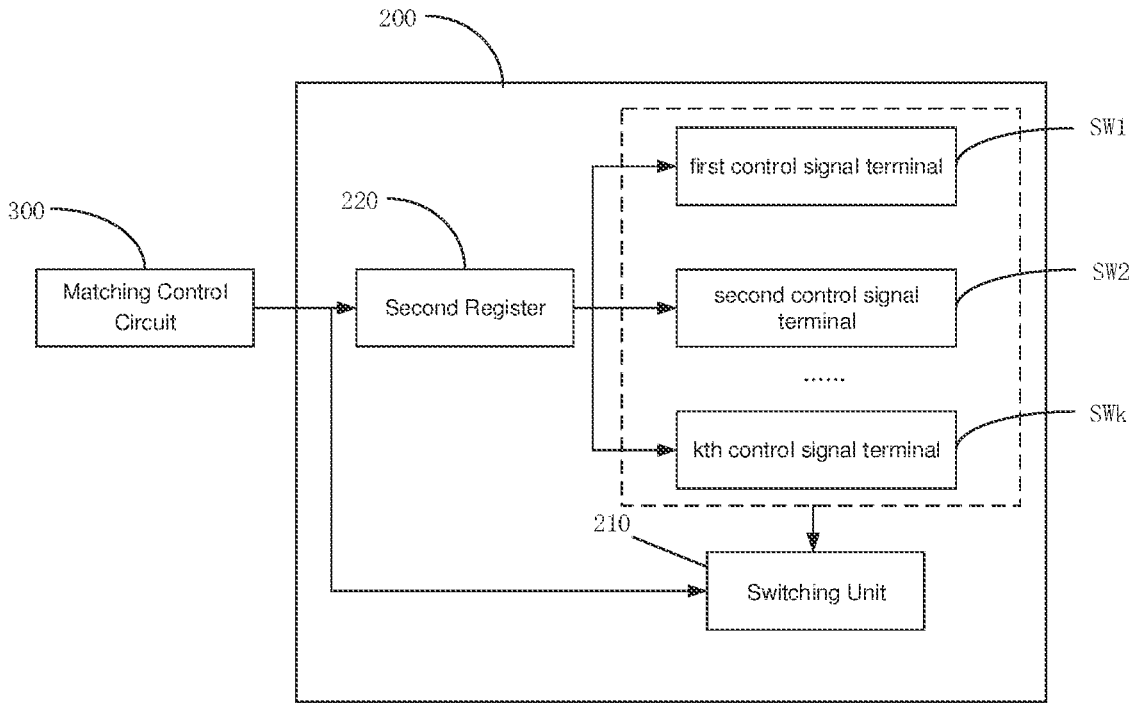
FIG. 8 is a further structure block diagram of a write control circuit according to an embodiment of the present disclosure.

Optionally, as shown in FIGS. 7 and 8, the write control circuit 200 includes N switching units 210, and the N switching units 210 correspond to N data signal terminals Vdata and N columns of pixel driving circuits one by one.

The matching control circuit 300 is connected to a control terminal of the first switching unit 211, a control terminal of the second switching unit 212, . . . , a control terminal of the Mth switching unit 21M. An input terminal of each switching unit 210 is connected to corresponding data signal terminal Vdata, and an output terminal of each switching unit 210 is connected to k data lines of the corresponding column of pixel driving circuits, so that the matching control circuit 300 can control the switching unit 210.

Specifically, the write control circuit 200 further includes a second register 220 corresponding to the switching unit 210. Each switching unit 210 includes k switching devices, and an input terminal of the second register 220 is connected to the matching control circuit 300, and an output terminal of the second register 220 is connected to a first control signal terminal SW1, a second control signal terminal SW2, . . . , a kth control signal terminal SWk. The first control signal terminal SW1 is connected to a control terminal of a first switching device 210*a* included in the switching unit 210. The second control signal terminal SW2 is connected to a control terminal of the second switching device 210*b* included in the switching unit 210, . . . , the kth control signal terminal SWk is connected to a control terminal of the kth switching device included in the switching unit 210. The input terminals of the k switching devices included in each switching unit 210 are connected to corresponding data signal terminals Vdata, and the output terminals of the k switching devices included in each switching unit 210 are connected to the k data lines of a corresponding column of pixel driving circuits one by one.

The second register 220 is configured to control the k switching devices in each of the switching units 210 to be sequentially turned on, such that turn-on times of adjacent two switching devices in each switching unit 210 are different by T/k, and each switching device remains to be turned on for a period of T/k.

Exemplarily, as shown in FIG. 2, if k=2, the data lines corresponding to each column of pixel driving circuits include two data lines, which are a first data line DATA1 and a second data line DATA2 respectively. 1 column by 4 rows of pixel driving circuits shown in FIG. 2 is taken as an example below for explanation.

As shown in FIG. 2 and FIG. 8, the write control circuit 200 includes a switching unit 210 including a first switching device 210*a* and a second switching device 210*b*. The write control circuit 200 also includes a second register 220. The second register 220 is connected to the first control signal terminal SW1. The first switching device 210*a* has a control terminal connected to the first control signal terminal SW1, an input terminal connected to the data signal terminal Vdata, and an output terminal connected to the first data line DATA1. The second register 220 is also connected to the second control signal terminal SW2. The second switching device 210*b* has a control terminal connected to the second control signal terminal SW2, an input terminal connected to the data signal terminal Vdata, and an output terminal connected to the second data line DATA2.

Exemplarily, as shown in FIG. 4, if k=2, for 3 columns by 4 rows of pixel driving circuits, three switching units 210 and three data signal terminals Vdata are involved, and the specific implementation of each switching unit 210 is the same as the implementation of the above-mentioned 1 column by 4 rows of pixel driving circuits. The three switching units 210 are the first switching unit 211, the second switching unit 212, and the third switching unit 213, respectively. The three data signal terminals Vdata are the first data signals terminal Vdata1, the second data signal terminal Vdata2, and third data signal terminal Vdata3 respectively, and the specific connection manner is as described above.

In a specific implementation, a matching signal can be provided to the second register 220 through the matching control circuit 300, so that the second register 220 provides a corresponding control signal to control the first switching device 210*a* or the second switching device 210*b* in each switching unit 210 to be turned on, and accordingly cause the first data line DATA1 or the second data line DATA2 to transmit a data signal.

For example, when the first register 102 provides a scanning signal to the first row of pixel driving circuits (first pixel driving circuit D1) of each column, the matching control circuit 300 sends a first matching signal to the second register 220, so that the second register 220 sends a first control signal to the first switching device 210*a* of the three switching units 210. The first switching device 210*a* of each switching unit 210 is turned on, so that a data signal corresponding to each switching unit 210 is transmitted to the first row of pixel driving circuits through the first data line DATA1. When the period for transmitting the data signal reaches T/2, and the first register 102 starts to provide a scanning signal to the second row of pixel driving circuits (second pixel driving circuit D2) of each column, the matching control circuit 300 sends a second matching signal to the second register 220, so that the second register 220 sends a second control signal to the second switching device 210*b* of each switching unit 210. The second switching device 210*b* of each switching unit 210 is turned on, so that a data signal corresponding to each switching unit 210 is transmitted to the second row of pixel driving circuits through the second data line DATA2. When the period of transmitting the data signal reaches T/2, the first register 102 provides a scanning signal to the third row of pixel driving circuits (third pixel driving circuit D3) of each column, and the matching control circuit 300 sends a first matching signal to the second register 220, so that the second register 220 sends a first control signal to the first switching device 210*a* of the three switching units 210. The first switching device 210*a* of each switching unit 210 is turned on, so that the data signal corresponding to each switching unit 210 is transmitted to the third row of pixel driving circuits through the first data line DATA1. When the period of transmitting the data signal reaches T/2, the first register 102 provides a scanning signal to the fourth row of pixels driving circuits (fourth pixel driving circuit D4) of each column, and the matching control circuit 300 sends a second matching signal to the second register 220, so that the second register 220 sends a second control signal to the second switching device 210*b* of each switching unit 210. The second switching device 210*b* of each switching unit 210 is turned on, so that a data signal corresponding to each switching unit 210 is transmitted to the fourth row of pixel driving circuits through the second data line DATA2.

Figure 9:
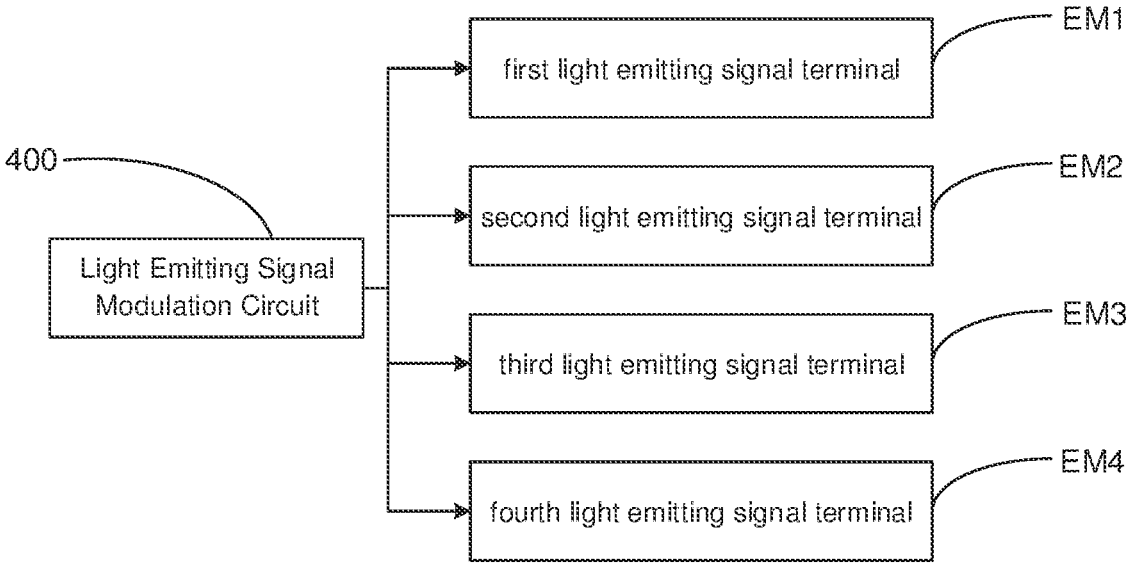
FIG. 9 is a structure block diagram of a light emitting signal modulation circuit according to an embodiment of the present disclosure.

Optionally, as shown in FIG. 1 and FIG. 9, the signal control apparatus provided according to the embodiment of the present disclosure may further include a light emitting signal modulation circuit 400 connected to the matching control circuit 300. The matching control circuit 300 controls the light emitting signal modulation circuit 400 to generate a light emitting signal at the end of the data signal writing phase, to control the pixel driving circuit to drive the light emitting device to emit light.

Specifically, for one row of pixel driving circuits, there is one light emitting signal terminal EM. When there is M rows of pixel driving circuits, the light emitting signal modulation circuit is connected to M light emitting signal terminals EM, and the M light emitting signal terminals EM are connected to M rows of pixel driving circuits one by one. The M light emitting signal terminals EM are connected to corresponding pixel driving circuits.

For example, for the 3 columns by 4 rows of pixel driving circuits shown in FIG. 4, the light emitting signal modulation circuit 400 is connected to the first light emitting signal terminal EM1, the second light emitting signal terminal EM2, the third light emitting signal terminal EM3, and the fourth light emitting signal terminal EM4. The first light emitting signal terminal EM1 is connected to the first row of pixel driving circuits, the second light emitting signal terminal EM2 is connected to the second row of pixel driving circuits, the third light emitting signal terminal EM3 is connected to the third row of pixel driving circuits, and the fourth light emitting signal terminal EM4 is connected to the fourth row of pixel driving circuits.

In a specific implementation, when the first register 102 starts to provide a scanning signal to the first row of pixel driving circuits, the matching control circuit 300 controls the light emitting signal modulation circuit 400 to generate a first light emitting signal when the first row of pixel driving circuits ends the data signal writing phase, and the first light emitting signal controls the first row of pixel driving circuits to drive the light emitting device thereof to emit light.

When the period for the first register 102 providing the scanning signal to the first row of pixel driving circuits reaches T/2, and the first register 102 starts to provide the scanning signal to the second row of pixel driving circuits, the matching control circuit 300 controls the light emitting signal modulation circuit 400 to generate a second light emitting signal when the second row of pixel driving circuits ends the data signal writing phase, and the second light emitting signal controls the second row of pixel driving circuits to drive the light emitting device thereof to emit light.

When the period for the first register 102 providing the scanning signal to the first row of pixel driving circuits reaches T, and the period for the first register 102 providing the scanning signal to the second row of pixel driving circuits reaches T/2, the first register 102 starts to provide the scanning signal to the third row of pixel driving circuits, the matching control circuit 300 controls the light emitting signal modulation circuit 400 to generate a third light emitting signal when the third row of pixel driving circuits ends the data signal writing phase, and the third light emitting signal controls the third row of pixel driving circuits to drive the light emitting device thereof to emit light.

When the period for the first register 102 providing the scanning signal to the second row of pixel driving circuits reaches T, and the period for the first register 102 providing the scanning signal to the third row of pixel driving circuits reaches T/2, the first register 102 starts to provide the scanning signal to the fourth row of pixel driving circuits, the matching control circuit 300 controls the light emitting signal modulation circuit 400 to generate a fourth light emitting signal when the fourth row of pixel driving circuits ends the data signal writing phase, and the fourth light emitting signal controls the fourth row of pixel driving circuits to drive the light emitting device thereof to emit light.

FIG. 4 illustrates an example where the scanning signal and the reset signal are provided at one side of a row of pixel driving circuit, i.e., a one-side driving scheme. If the remote pixel driving circuit in the row of pixel driving circuits is far away from the scanning signal terminal and the reset signal terminal, the received scanning signal and the reset signal may be degraded. FIG. 4-1 illustrates another example where the scanning signal and the reset signal are provided from the phase shifting circuit at two sides of a row of pixel driving circuit, i.e., a two-side driving scheme, to overcome the drawback of one-side driving scheme.

Figure 12:
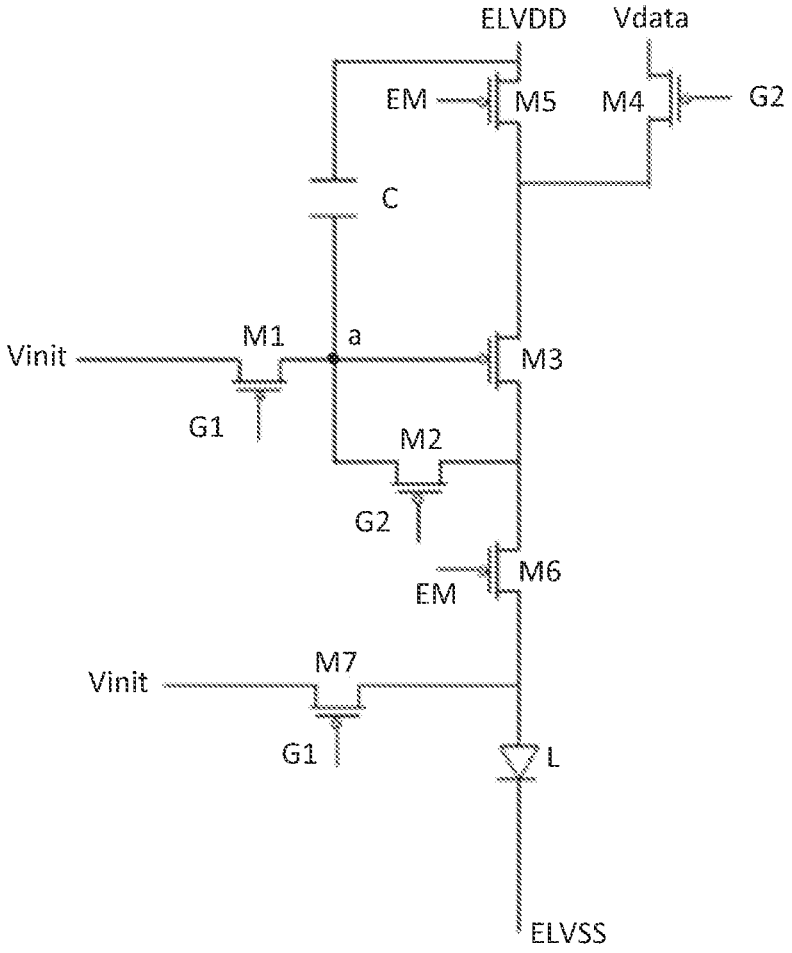
FIG. 12 is a circuit structure diagram of a pixel driving circuit according to an embodiment of the present disclosure.

The matching control circuit 300 may be implemented as a driving integrated circuit or a timing control circuit on the printed circuit board (PCB) of the display apparatus. It should be noted that the specific form of the pixel driving circuit involved in the embodiment of the present disclosure is various. FIG. 12 illustrates a pixel driving circuit according to an embodiment of the present disclosure. As shown in FIG. 12, the pixel driving circuit may include: a first transistor M1, a second transistor M2, and a third transistor M3, a fourth transistor M4, a fifth transistor M5, a sixth transistor M6, a seventh transistor M7, a storage capacitor C, and light emitting device L. The first transistor M1, the second transistor M2, the third transistor M3, the fourth transistor M4, the fifth transistor M5, the sixth transistor M6, and the seventh transistor M7 are all PMOS transistors, and have a characteristic of being turned on by a low-level signal and turned off by a high-level signal.

The first transistor M1 has a control terminal connected to a reset signal terminal G1, an input terminal connected to an initial signal terminal Vinit, and an output terminal connected to a first plate of the storage capacitor C. A second plate of the storage capacitor C is connected to a first power signal terminal ELVDD.

The fifth transistor M5 has a control terminal connected to a light emitting signal terminal EM, an input terminal connected to the first power signal terminal ELVDD, and an output terminal connected to an input terminal of the third transistor M3.

The fourth transistor M4 has a control terminal connected to a scanning signal terminal G2, an input terminal connected to the data signal terminal Vdata, and an output terminal connected to the input terminal of the third transistor M3.

The output terminal of the first transistor M1 is also connected to the control terminal of the third transistor M3, and the output terminal of the third transistor M3 is connected to an input terminal of the second transistor M2 and an input terminal of the sixth transistor M6 respectively. An output terminal of the second transistor M2 is connected to the first plate of the storage capacitor C, and a control terminal of the second transistor M2 is connected to the scanning signal terminal G2. A control terminal of the sixth transistor M6 is connected to the light emitting signal terminal EM, and an output terminal of the sixth transistor M6 is connected to a positive electrode of the light emitting device L. A negative electrode of the light emitting device L is connected to a second power signal terminal ELVSS.

The seventh transistor M7 has a control terminal connected to the reset signal terminal G1, an input terminal connected to the initial signal terminal Vinit, and an output terminal connected to the positive electrode of the light emitting device L.

Figure 13:
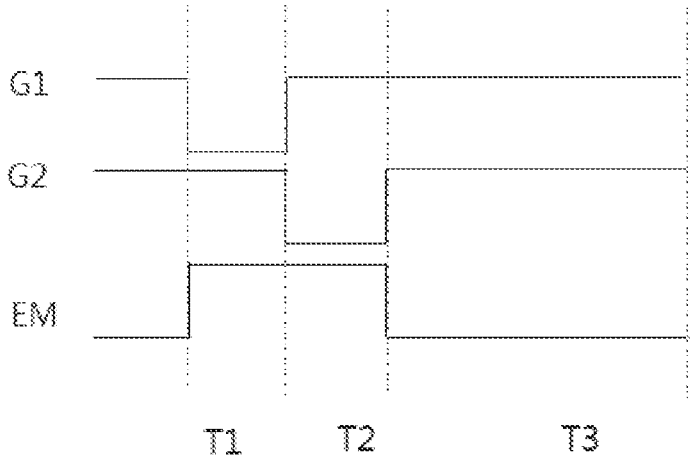
FIG. 13 is a timing diagram of a pixel driving circuit according to an embodiment of the present disclosure.

As shown in FIG. 13, in a first time period T1, the reset signal terminal G1 provides a low-level reset signal, the first transistor M1 is turned on; the seventh transistor M7 is turned on, so that an initial voltage is written into the first plate of the storage capacitor C, and the node a is reset, a voltage of the node a is equal to the voltage of the initial signal; the scanning signal terminal G2 provides a high-level scanning signal, and the second transistor M2 and the fourth transistor M4 are all turned off; the light emitting signal terminal EM provides a high-level light emitting signal, and the fifth transistor M5 and the sixth transistor M6 are turned off.

In a second time period T2, the reset signal terminal G1 provides a high-level reset signal, and the first transistor M1 and the seventh transistor M7 are both turned off; the light emitting signal terminal EM provides a high-level light emitting signal, so that the fifth transistor M5 and the sixth transistor M6 are turned off; the scanning signal terminal G2 provides a low-level scanning signal, the second transistor M2 and the fourth transistor M4 are turned on, and the third transistor M3 is turned on under the control of the initial signal voltage; when the voltage of the data signal is written into the first plate of the storage capacitor C through the fourth transistor M4, the third transistor M3 and the second transistor M2, the voltage of the node a is equal to Vdata+Vth, wherein Vdata is a data signal voltage, and Vth is a compensation voltage.

In a third time period T3, the reset signal terminal G1 provides a high-level reset signal, and the first transistor M1 and the seventh transistor M7 are both turned off; the scanning signal terminal G2 provides a high-level scanning signal, and the second transistor M2 and the fourth transistor M4 are turned off; the third transistor M3 maintains a turn-on state, and the light emitting signal terminal EM provides a low-level light emitting signal, so that the fifth transistor M5 and the sixth transistor M6 are turned on; at this time, a power supply signal supplied from the first power supply signal terminal ELVDD drives the light emitting device L to emit light via the fifth transistor M5, the third transistor M3, and the sixth transistor M6.

It should be noted that the fourth transistor M4 in the pixel driving circuit is shown to be connected directly to the data signal terminal Vdata, but it is substantially connected to the switching unit 210 of the write control circuit 200 through the data line in the present disclosure, and writing of data signals is enabled under the control of the write control circuit 200.

Figure 14:
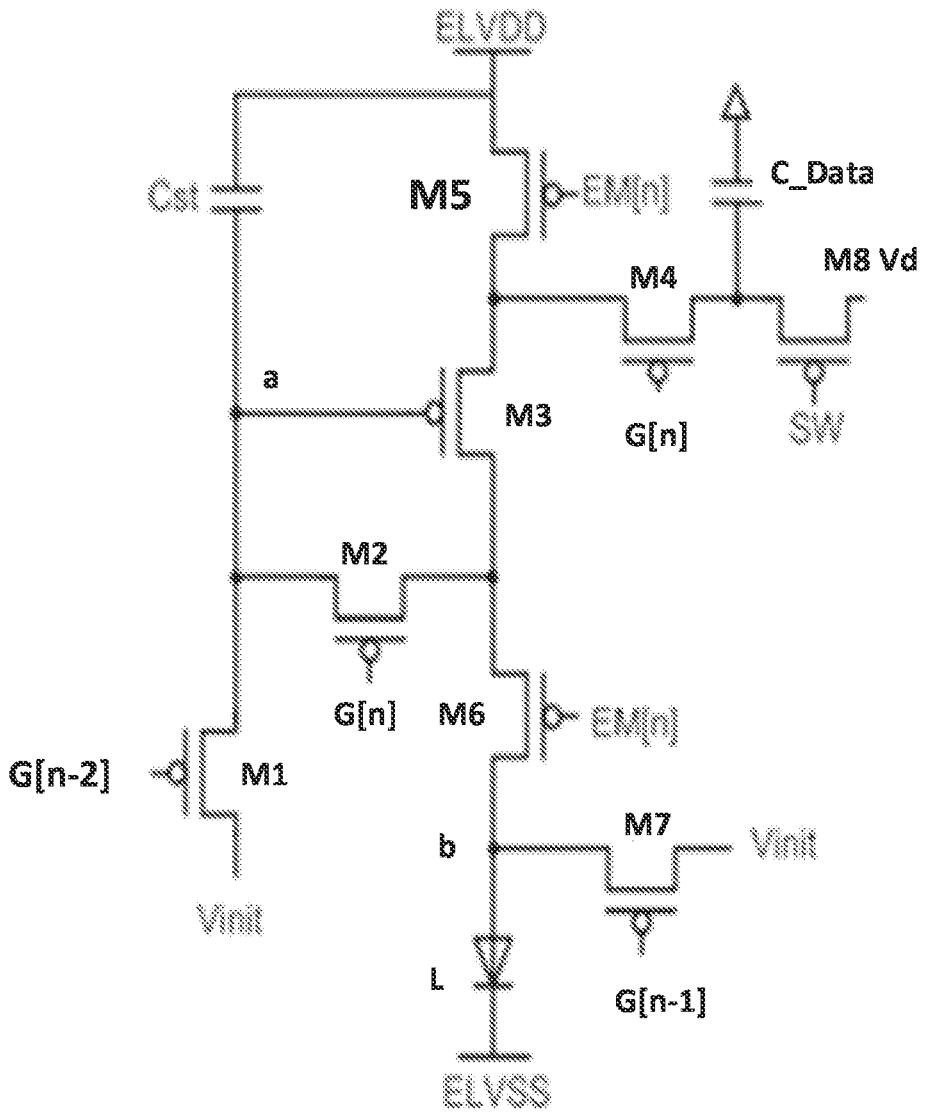
FIG. 14 is a circuit structure diagram of a pixel driving circuit according to another embodiment of the present disclosure.

FIG. 14 illustrates a pixel driving circuit according to another embodiment of the present disclosure. As shown in FIG. 14, the pixel driving circuit may include: a first transistor M1, a second transistor M2, and a third transistor M3, a fourth transistor M4, a fifth transistor M5, a sixth transistor M6, a seventh transistor M7, an eighth transistor T8, a storage capacitor Cst, and light emitting device L. The first transistor M1, the second transistor M2, the third transistor M3, the fourth transistor M4, the fifth transistor M5, the sixth transistor M6, and the seventh transistor M7 are all PMOS transistors, and have a characteristic of being turned on by a low-level signal and turned off by a high-level signal.

The first transistor M1 has a control terminal connected to a first reset signal terminal G[n−2], an input terminal connected to an initial signal terminal Vinit, and an output terminal connected to a first plate of the storage capacitor Cst. A second plate of the storage capacitor Cst is connected to a first power signal terminal ELVDD.

The fifth transistor M5 has a control terminal connected to a light emitting signal terminal EM[n], an input terminal connected to the first power signal terminal ELVDD, and an output terminal connected to an input terminal of the third transistor M3.

The fourth transistor M4 has a control terminal connected to a scanning signal terminal G[n], an input terminal connected to the output terminal of the eighth transistor T8, and an output terminal connected to an input terminal of the third transistor M3.

The eighth transistor T8 has a control terminal connected to a data writing control terminal SW, and an input terminal connected to the data signal terminal Vd.

The output terminal of the first transistor M1 is also connected to the control terminal of the third transistor M3, and the output terminal of the third transistor M3 is connected to an input terminal of the second transistor M2 and an input terminal of the sixth transistor M6 respectively. An output terminal of the second transistor M2 is connected to the first plate of the storage capacitor Cst, and a control terminal of the second transistor M2 is connected to the scanning signal terminal G[n]. A control terminal of the sixth transistor M6 is connected to the light emitting signal terminal EM[n], and an output terminal of the sixth transistor M6 is connected to a positive electrode of the light emitting device L. A negative electrode of the light emitting device L is connected to a second power signal terminal ELVSS.

The seventh transistor M7 has a control terminal connected to the second reset signal terminal G[n−1], an input terminal connected to the initial signal terminal Vinit, and an output terminal connected to the positive electrode of the light emitting device L.

Figure 15:
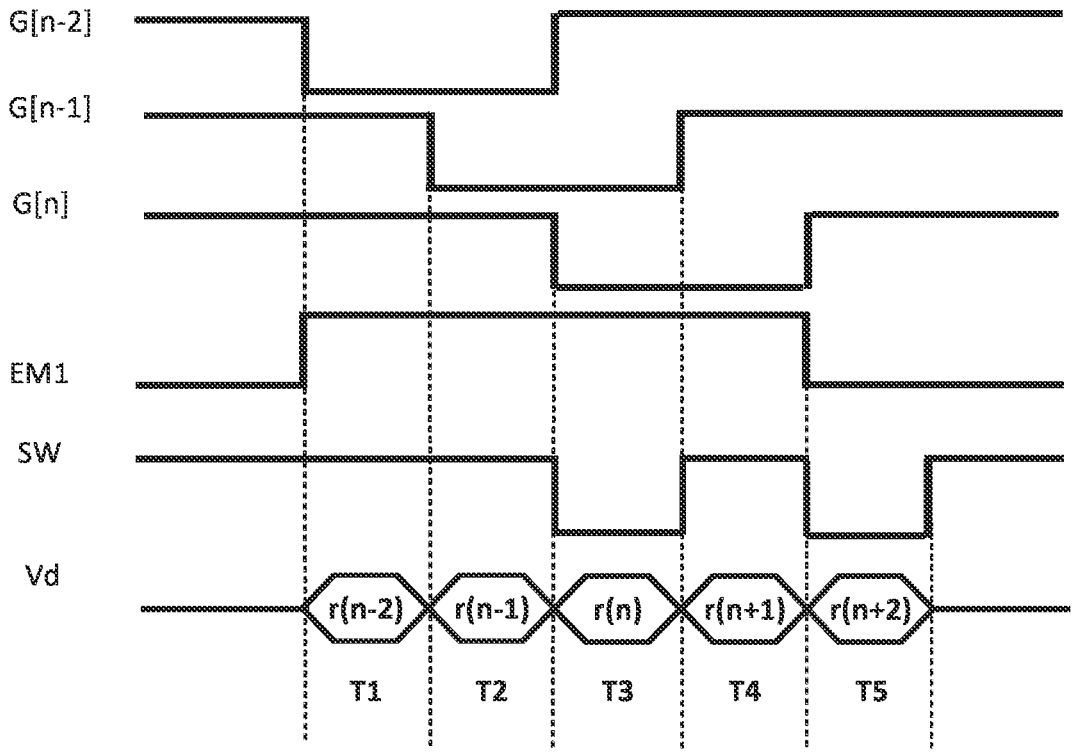
FIG. 15 is a timing diagram of a pixel driving circuit according to another embodiment of the present disclosure.

As shown in FIG. 15, in a first time period T1, the first reset signal terminal G[n−2] provides a low-level reset signal, the first transistor M1 is turned on so that an initial voltage is written into the first plate of the storage capacitor Cst, and the node a is reset, a voltage of the node a is equal to the voltage of the initial signal. The scanning signal terminal G[n] provides a high-level scanning signal, and the second transistor M2 and the fourth transistor M4 are all turned off; the light emitting signal terminal EM[n] provides a high-level light emitting signal, and the fifth transistor M5 and the sixth transistor M6 are turned off. The second reset signal terminal G[n−1] provides a high-level reset signal, the seventh transistor M7 is turned off. The data writing control terminal SW provides a high-level light emitting signal, and the eighth transistor M8 is turned off.

In a second time period T2, the first reset signal terminal G[n−2] provides a high-level reset signal, the first transistor M1 is turned off. The second reset signal terminal G[n−1] provides a low-level reset signal, the seventh transistor M7 is turned on, so that the node b is reset, and a voltage of the node b is equal to the voltage of the initial signal. The first reset signal terminal G[n−2] provides a high-level reset signal, the first transistor M1 is turned off. The scanning signal terminal G[n] provides a high-level scanning signal, and the second transistor M2 and the fourth transistor M4 are all turned off; the light emitting signal terminal EM[n] provides a high-level light emitting signal, and the fifth transistor M5 and the sixth transistor M6 are turned off. The second reset signal terminal G[n−1] provides a high-level reset signal, the seventh transistor M7 is turned off. The data writing control terminal SW provides a high-level light emitting signal, and the eighth transistor M8 is turned off.

In a third time period T3, the first reset signal terminal G[n−2] and the second reset signal terminal G[n−1] provide a high-level reset signal, and the first transistor M1 and the seventh transistor M7 are both turned off; the light emitting signal terminal EM[n] provides a high-level light emitting signal, so that the fifth transistor M5 and the sixth transistor M6 are turned off; the scanning signal terminal G[n] and the data writing control terminal SW provide a low-level scanning signal, the second transistor M2, the fourth transistor M4 and the eighth transistor M8 are turned on, and the third transistor M3 is turned on under the control of the initial signal voltage; when the voltage of the data signal is written into the first plate of the storage capacitor Cst through the fourth transistor M4, the third transistor M3 and the second transistor M2.

In a fourth time period T4, the first reset signal terminal G[n−2] and the second reset signal terminal G[n−1] provide a high-level reset signal, and the first transistor M1 and the seventh transistor M7 are both turned off; the light emitting signal terminal EM[n] provides a high-level light emitting signal, so that the fifth transistor M5 and the sixth transistor M6 are turned off; the data writing control terminal SW provide a low-level scanning signal, the eighth transistor M8 is turned off. The scanning signal terminal G[n] provides a low-level scanning signal, the second transistor M2 and the fourth transistor M4 are turned on, and the third transistor M3 maintains a turn-on state. The stored charge due to the mutual capacitance (about 20 pF) of the data line (shown as C_data) continues charging the first plate of the storage capacitor Cst through the fourth transistor M4, the third transistor M3 and the second transistor M2, until the voltage of the node a is equal to Vdata+Vth, wherein Vdata is a data signal voltage, and Vth is a compensation voltage.

In a fifth time period T5, the first reset signal terminal G[n−2] and the second reset signal terminal G[n−1] provide a high-level reset signal, and the first transistor M1 and the seventh transistor M7 are both turned off; the data writing control terminal SW provide a low-level scanning signal, the eighth transistor M8 is turned off. The scanning signal terminal G[n] provides a high-level scanning signal, the second transistor M2 and the fourth transistor M4 are turned off. The light emitting signal terminal EM[n] provides a low-level light emitting signal, so that the fifth transistor M5 and the sixth transistor M6 are turned on. At this time, a power supply signal supplied from the first power supply signal terminal ELVDD drives the light emitting device L to emit light via the fifth transistor M5, the third transistor M3, and the sixth transistor M6.

The data writing period of the present disclosure is the period during which the data signal is provided from the data signal terminal to the pixel driving circuit. The data signal writing phase of the present disclosure is a duration during which the data signal is provided to the pixel driving circuit. The first part of the data signal writing phase is the data writing period, and the second part of the data signal writing phase is a duration during which the data signal is provided from the mutual capacitance to the pixel driving circuit.

It should be noted that the fourth transistor M4 in the pixel driving circuit is shown to be connected directly to the data signal terminal Vdata, but it is substantially connected to the switching unit 210 of the write control circuit 200 through the data line in the present disclosure, and writing of data signals is enabled under the control of the write control circuit 200.

The symbols on the line Vd, r(n−2), r(n−1), r(n), r(n+1) and r(+2) denote the data signal to be provided to the [n−2]th row, [n−1]th row, [n]th row, [n+1]th row and [n+2]th row of pixel driving circuits.

It should be noted that the timing diagrams shown in FIGS. 3, 13 and 15 are only an example for illustration, and may not be the same as the actual timing diagram. For example, in some embodiments, each signal may not be a square wave as shown in FIGS. 3, 13 and 15, but a waveform in which slight jitters may appear over time, or the rising/falling edge of the signal is not as shown in FIGS. 3, 13 and 15 is the same as vertical, but a certain slope. Accordingly, the data signal writing phase is smaller than T in the actual cases.

As shown in FIG. 1 to FIG. 4 and FIG. 10, the embodiment of the present disclosure further provides a signal control method 900, which is applied to the signal control apparatus according to the foregoing embodiment. The signal control method includes the following steps.

At Step S910, a scanning signal is provided to a pixel driving circuit by for example a phase shifting circuit 100, to cause the pixel driving circuit to enter a data signal writing phase, wherein a phase difference between scanning signals of adjacent two pixel driving circuits of the same group of pixel driving circuits in the same column of pixel driving circuits is equal to T, and a phase difference between scanning signals of adjacent two pixel driving circuits in the same column of pixel driving circuits is equal to T/k, T is a duration of a data signal writing phase of each pixel driving circuit.

At Step S920, a data signal is provided to a pixel driving circuit that receives a scanning signal by for example the matching control circuit 300 for a data writing period of $T_i$=T/k, when the scanning signal is provided to the pixel driving circuit by for example the phase shifting circuit 100.

Figure 10:
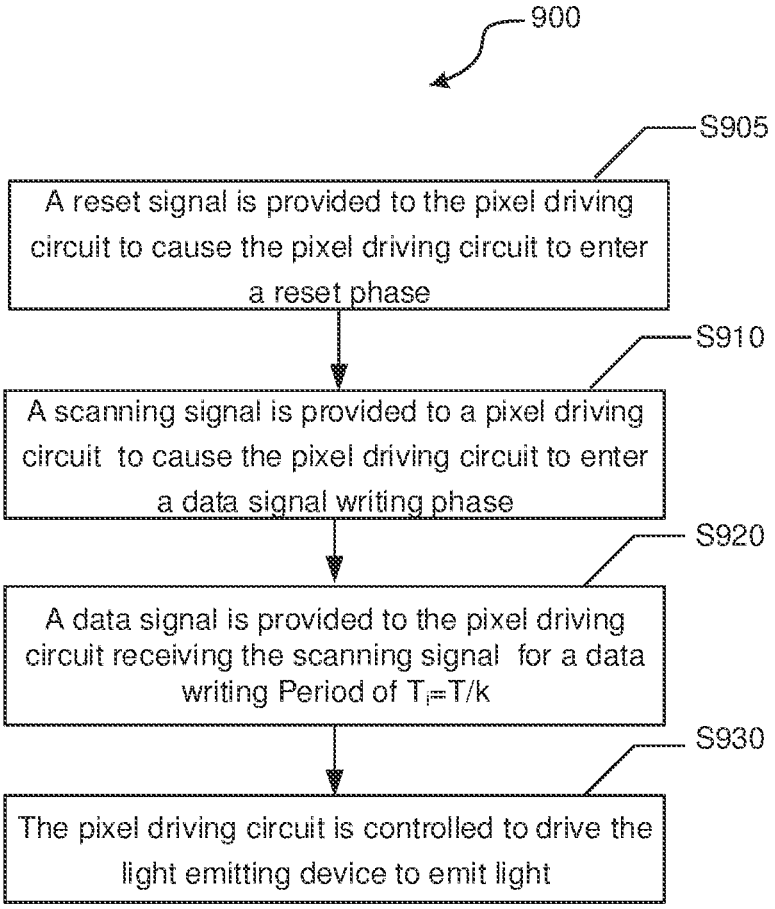
FIG. 10 is a flow chart of a signal control method according to an embodiment of the present disclosure.

Specifically, as shown in FIG. 10, prior to providing the scanning signal to the pixel driving circuit, the signal control method according to the present disclosure may further include Step S905 in which a reset signal is provided to the pixel driving circuit to cause the pixel driving circuit to enter a reset phase, where a duration of the reset phase is equal to T.

As shown in FIG. 10, after the data signal writing phase, the signal control method according to the present disclosure may further include Step S930, in which the pixel driving circuit is controlled to drive the light emitting device to emit light.

The beneficial effects of the signal control method according to the embodiments of the present disclosure compared with the prior art are the same as those of the signal control apparatus according to the foregoing technical solution, and are not described herein.

The embodiment of the present disclosure further provides a display control apparatus, which includes the signal control apparatus according to the embodiment of the present disclosure.

The beneficial effects of the display control apparatus according to the embodiments of the present disclosure compared with the prior art are the same as those of the signal control apparatus according to the foregoing technical solution, and are not described herein.

As shown in FIG. 1 to FIG. 4 and FIG. 11, the embodiment of the present disclosure further provides a display control method 1000 applied to a signal control apparatus according to an embodiment of the present disclosure. The display control method includes the following steps.

At Step S100, i.e., a data writing step, a scanning signal is provided to a current row of pixel driving circuits, so that the current row of pixel driving circuits enters a data signal writing phase, and the duration of the data signal writing phase is equal to T; and at the same time a data signal from the data signal terminal is provided to the current row of pixel driving circuit, so that the current row of pixel driving circuits writes the data signal for a data writing period of $T_i$=T/k; and it stops providing the data signal to the current row of pixel driving circuits via the data signal terminal after the data writing period lapses, and proceeds to a mutual capacitance charging step.

At Step S200, i.e., the mutual capacitance charging step, the data lines corresponding to each pixel driving circuit in the current row of pixel driving circuits is caused to charge the corresponding pixel driving circuit by using the mutual capacitance of the data lines corresponding to each pixel driving circuit in the current row of pixel driving circuits, until the data signal writing phase of the corresponding pixel driving circuit ends.

Figure 11:
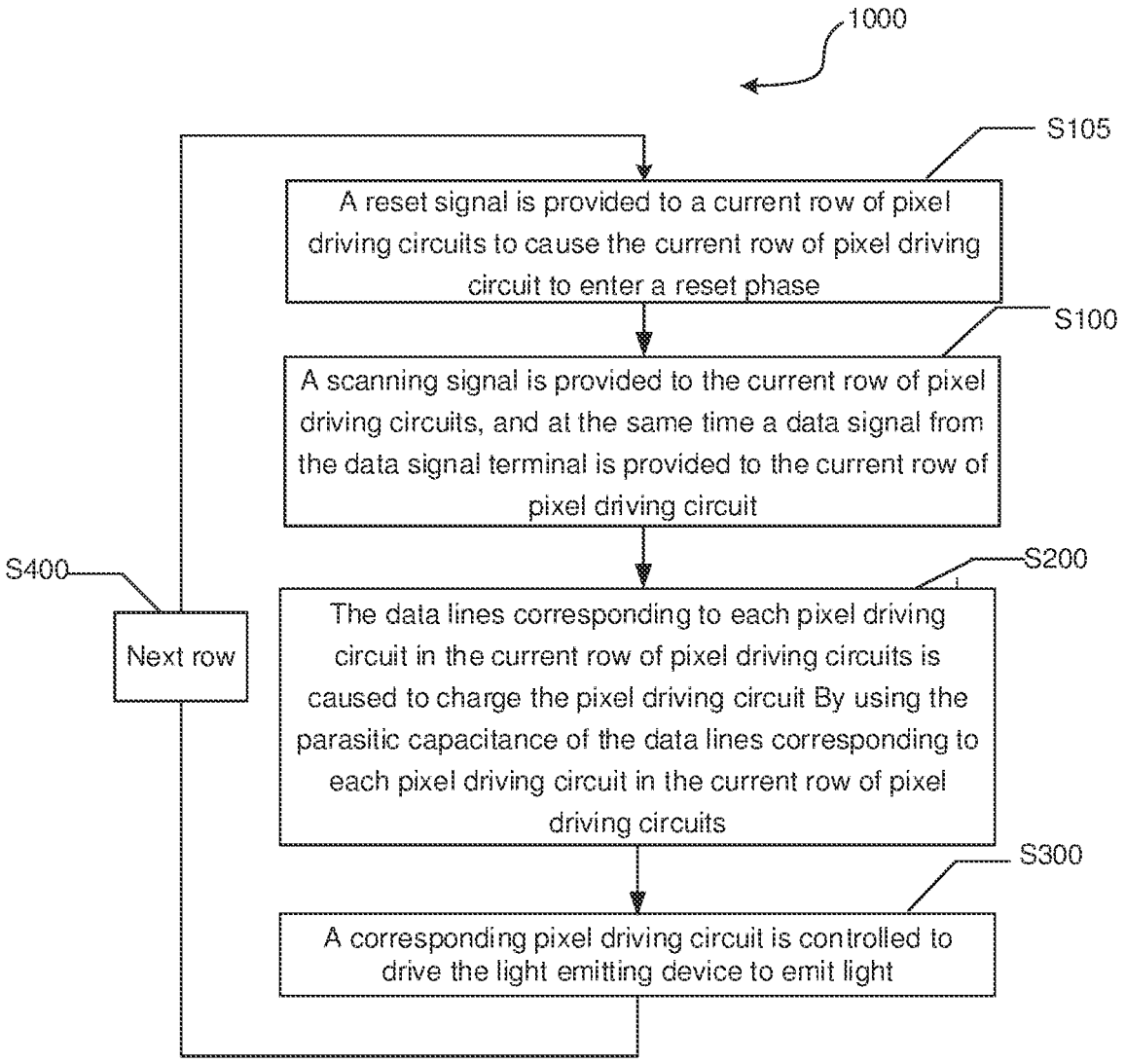
FIG. 11 is a flow chart of a display control method according to an embodiment of the present disclosure.

As shown in FIG. 11, the display control method according to an embodiment of the present disclosure further includes Step S400, i.e., an updating step, in which it performs a data writing step and a mutual capacitance charging step for the next row of pixel driving circuits.

As shown in FIG. 11, after the mutual-capacitance charging step, the display control method according to an embodiment of the present disclosure further includes Step S300, i.e., a light emitting driving step, in which a corresponding pixel driving circuit is controlled to drive the light emitting device to emit light.

As shown in FIG. 11, before the data writing step, the display control method according to an embodiment of the present disclosure further includes Step S105, i.e., a reset step, in which a reset signal is provided to the current row of pixel driving circuits to cause the current row of pixel driving circuit to enter a reset phase, wherein a duration of the reset phase is equal to T.

The beneficial effects of the display control method according to the embodiments of the present disclosure compared with the prior art are the same as those of the signal control apparatus according to the foregoing embodiments, and are not described herein.

The specific operation process of the display control method according to the embodiment of the present disclosure is described in detail below by using FIG. 3 and FIG. 4 as an example.

In the first step, i.e., the data writing step, the phase shifting circuit 100 provides a scanning signal to the current row of pixel driving circuits. In particular, the phase shifting circuit 100 provides a scanning signal to the first row of pixel driving circuits (the first pixel driving circuit D1), so that the first row of pixel driving circuits enters a data signal writing phase, and at this time the write control circuit 200 controls the first data line DATA1 corresponding to each column of the pixel driving circuit to provide the data signal from the data signal terminal to the first row of pixel driving circuits, so that the first row of pixel driving circuits writes the data signal in a corresponding pixel for a data writing period of $T_i$=T/k. The write control circuit 200 stops providing the data signal from the data signal terminal to the first row of pixel driving circuits after the data writing period lapses, and the method proceeds to a mutual capacitance charging step.

In the second step, i.e., the mutual capacitance charging step, the phase shifting circuit 100 continues to provide the scanning signal to the first row of pixel driving circuits, and the mutual capacitance of a data line corresponding to each pixel driving circuit in the first row of pixel driving circuits causes the first data line DATA1 to charge the first row of pixel driving circuits until the data signal writing phase of the first row of pixel driving circuits ends.

In the third step, i.e., the light emitting driving step, a light emitting signal provided from the light emitting signal modulation circuit 400 controls the first row of pixel driving circuits to drive the first row of light emitting devices to emit light.

In the fourth step, i.e., the updating step, a data writing step and a mutual capacitance charging for the next row of pixel driving circuits is performed.

The embodiment of the present disclosure further provides a display apparatus, which includes the display control apparatus according to the above embodiment.

The beneficial effects of the display apparatus according to the embodiment of the present disclosure compared with the prior art are the same as those of the signal control apparatus according to the foregoing embodiment, and are not described herein.

The display apparatus provided in the foregoing embodiment may be any product or part having a display function, such as a mobile phone, a tablet computer, a television, a display, a notebook computer, a digital photo frame, or a navigator.

In the description of the above embodiments, specific features, structures, materials or characteristics may be combined in any suitable manner in any one or more embodiments or examples.

The above description is only the specific embodiment of the present disclosure, but the scope of the present disclosure is not limited thereto, and any person skilled in the art can easily conceive of changes or substitutions within the technical scope of the present disclosure. Such changes or substitutions should be included within the scope of protection of the present disclosure. Therefore, the scope of protection of the present disclosure should be subject to the scope of protection of the claims.

We claim:

1. A signal control apparatus for a display apparatus, the display apparatus comprising M rows by N columns of pixel driving circuits arranged in an array, wherein the M pixel driving circuits of each column of pixel driving circuits are grouped into at least a first group of pixel driving circuits and a second group of pixel driving circuits, M and N each being an integer and N being larger than 2, and the first group of pixel driving circuits are connected to a first data line to receive a data signal, and the second group of pixel driving circuits are connected to a second data line to receive a data signal, the signal control apparatus comprising:

a phase shifting circuit configured to provide a scanning signal to a pixel driving circuit, wherein the phase shifting circuit includes a phase shifter and a first register, and wherein the phase shifter is connected to an input terminal of the first register, an output terminal of the first register is connected to at least one of M scanning signal terminals, and the M scanning signal terminals correspond to M pixel driving circuits in the same column of pixel driving circuits one by one, wherein one of the scanning signals of adjacent two pixel driving circuits in the same column of pixel driving circuits is shifted with respect to the other one of the scanning signals of the adjacent two pixel driving circuits in the same column of pixel driving circuits by a factor smaller than a duration of a data signal writing phase of each pixel driving circuit.

2. The signal control apparatus according to claim 1, wherein the M pixel driving circuits of each column of pixel driving circuits are grouped into k groups, wherein k is greater than or equal to 2 and less than N, the phase shifting circuit is configured to provide the scanning signal to the pixel driving circuit to cause the pixel driving circuit to enter a data signal writing phase, and T is the duration of the data signal writing phase of each pixel driving circuit.

3. The signal control apparatus according to claim 2, wherein the factor of adjacent two pixel driving circuits in the same column of pixel driving circuits is equal to T−T/k.

4. The signal control apparatus according to claim 2, wherein the factor of adjacent k pixel driving circuits in the same column of pixel driving circuits is equal to T/k.

5. The signal control apparatus according to claim 1, further comprising: a write control circuit connected to N data signal terminals, and configured to provide a data signal from the N data signal terminals to the pixel driving circuits, the N data signal terminals corresponding to the N columns of pixel driving circuits one by one, wherein the phase shift circuit is controlled so that it provides a scanning signal to a pixel driving circuit for a period longer than a period for which the write control circuit provides the data signal from the corresponding data signal terminal to the pixel driving circuit.

6. The signal control apparatus according to claim 2, wherein in the duration of one data signal writing phase, the phase shifting circuit sequentially provide the scanning signal to k different pixel driving circuits so that the k different pixel driving circuits receive the scanning signal to complete data signal writing.

7. The signal control apparatus according to claim 2, wherein the scanning signal is used for controlling a duration of the data signal writing phase of a corresponding pixel driving circuit.

8. The signal control apparatus according to claim 1, wherein the phase shifting circuit is configured to provide a scanning signal to a row of pixel driving circuits from both sides of the row of pixel driving circuits.

9. The signal control apparatus according to claim 1, further comprising an light emitting signal modulation circuit, wherein the light emitting signal modulation circuit is controlled to generate a light emitting signal and provide it to a pixel driving circuit, to cause the pixel driving circuit that receives the light emitting signal to drive a light emitting device to emit light.

10. A signal control method applied to the signal control apparatus of claim 1, comprising:

providing a scanning signal to a pixel driving circuit; and providing a data signal to a pixel driving circuit via the corresponding data signal terminal, wherein the scanning signal is provided to a pixel driving circuit for a period longer than a period for which the pixel driving circuit is provided with the data signal via the corresponding data signal terminal.

11. The signal control method according to claim 10, wherein before providing the scanning signal to the pixel driving circuit, the method further comprises:

providing a reset signal to the pixel driving circuit to cause the pixel driving circuit to enter a reset phase.

12. The signal control method according to claim 10, further comprising:

controlling the pixel driving circuit to drive a light emitting device to emit light.

13. A display control apparatus comprising the signal control apparatus of claim 1.

14. A signal control method applied to the signal control apparatus of claim 1, comprising:

a data writing step of providing a scanning signal to a current row of pixel driving circuits, and at the same time, providing a data signal from a data signal terminal to the current row of pixel driving circuit, such that the current row of pixel driving circuits writes the data signal for a data writing period;

stopping providing the data signal to the current row of pixel driving circuits via the data signal terminal after the data writing period lapses, and proceeding to a mutual capacitance charging step;

the mutual capacitance charging step of utilizing a mutual capacitance of a data line corresponding to each pixel driving circuit in the current row of pixel driving circuits while continuing providing the scanning signal to the current row of pixel driving circuits, so that the data line corresponding to each pixel driving circuit in the current row of pixel driving circuits charges the corresponding pixel driving circuit until no scanning signal is provided to the current row of pixel driving circuits.

15. The signal control method according to claim 14, further comprising:

performing the data writing step and the mutual capacitance charging step for a next row of pixel driving circuits.

16. The signal control method according to claim 14, after the mutual capacitance charging step, further comprising:

a driving step of controlling the current row of pixel driving circuits to drive a light emitting device to emit light.

17. The signal control method according to claim 14, before the data writing step, further comprising:

a resetting step of providing a reset signal to the current row of pixel driving circuits to cause the current row of pixel driving circuits to enter a reset phase.

18. A display apparatus comprising a display control apparatus comprising a signal control apparatus for the display apparatus, the display apparatus comprising M rows by N columns of pixel driving circuits arranged in an array, wherein the M pixel driving circuits of each column of pixel driving circuits are grouped into at least a first group of pixel driving circuits and a second group of pixel driving circuits, M and N each being an integer and N being larger than 2, and the first group of pixel driving circuits are connected to a first data line to receive a data signal, and the second group of pixel driving circuits are connected to a second data line to receive a data signal, the signal control apparatus comprising:

a phase shifting circuit configured to provide a scanning signal to a pixel driving circuit, wherein the phase shifting circuit includes a phase shifter and a first register, and wherein the phase shifter is connected to an input terminal of the first register, an output terminal of the first register is connected to at least one of M scanning signal terminals, and the M scanning signal terminals correspond to M pixel driving circuits in the same column of pixel driving circuits one by one, wherein one of the scanning signals of adjacent two pixel driving circuits in the same column of pixel driving circuits is shifted with respect to the other one of the scanning signals of the adjacent two pixel driving circuits in the same column of pixel driving circuits by a factor smaller than a duration of a data signal writing phase of each pixel driving circuit.

* * * * *